US007558608B2

(12) United States Patent
Akasegawa et al.

(10) Patent No.: US 7,558,608 B2
(45) Date of Patent: Jul. 7, 2009

(54) SUPERCONDUCTING DEVICE, FABRICATION METHOD THEREOF, AND FILTER ADJUSTING METHOD

(75) Inventors: Akihiko Akasegawa, Kawasaki (JP); Manabu Kai, Kawasaki (JP); Teru Nakanishi, Kawasaki (JP); Kazunori Yamanaka, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 168 days.

(21) Appl. No.: 11/233,074

(22) Filed: Sep. 23, 2005

(65) Prior Publication Data

US 2007/0229183 A1 Oct. 4, 2007

(30) Foreign Application Priority Data

Sep. 29, 2004 (JP) ..... 2004-284670
Oct. 18, 2004 (JP) ..... 2004-303301
Aug. 11, 2005 (JP) ..... 2005-233037

(51) Int. Cl.
*H01P 1/203* (2006.01)
*H01B 12/02* (2006.01)

(52) U.S. Cl. ..... 505/210; 333/99 S; 333/204; 333/219

(58) Field of Classification Search ..... 333/204, 333/219, 99 S; 505/210
See application file for complete search history.

(56) References Cited

U.S. PATENT DOCUMENTS 4,313,097 A * 1/1982 de Ronde ..... 333/204
5,136,268 A 8/1992 Fiedziuszko et al. ..... 333/204
5,172,084 A * 12/1992 Fiedziuszko et al. ..... 333/204
6,057,271 A 5/2000 Kenjiro et al.
6,144,268 A 11/2000 Matsui et al.
6,496,710 B1 12/2002 Tsuzuki
6,507,251 B2 1/2003 Mizoguchi et al. ..... 333/134
6,823,201 B2 11/2004 Kai et al. ..... 505/210
6,943,651 B2 9/2005 Mukaiyama et al. ..... 333/219.1
6,980,841 B2 12/2005 Kai et al. ..... 505/210
2004/0021531 A1* 2/2004 Mukaiyama et al. ..... 333/202

FOREIGN PATENT DOCUMENTS

JP 3-194979 8/1991
JP 4-330805 11/1992
JP 5-251904 9/1993
JP 8-288707 11/1996
JP 10-041557 2/1998
JP 10-173405 6/1998

(Continued)

OTHER PUBLICATIONS

Japanese Office Action mailed Jul. 8, 2008, issued in corresponding Japanese Application No. 2004-284670, including English-translation. (4 pages).

(Continued)

*Primary Examiner*—Benny T. Lee
(74) *Attorney, Agent, or Firm*—Kratz, Quintos & Hanson, LLP.

(57) ABSTRACT

A superconducting device comprises a dielectric substrate, and a plane-figure type resonator pattern made of a superconductive material and formed on a first face of the dielectric substrate. The resonator pattern has a notch at least a portion of which is round.

8 Claims, 28 Drawing Sheets

FOREIGN PATENT DOCUMENTS

| | | |
|---|---|---|
| JP | 11-177310 | 7/1999 |
| JP | 2001-308603 | 11/2001 |
| JP | 2002-171107 | 6/2002 |
| JP | 2003-87009 | 3/2003 |
| JP | 2003-309405 | 10/2003 |
| WO | WO 01/56107 | 8/2001 |
| WO | WO 03/075392 A1 | 9/2003 |

OTHER PUBLICATIONS

Japanese Office Action mailed Jul. 8, 2008, issued in basic Japanese Application No. 2004-303301, including English-translation. (4 pages).

Japanese Office Action mailed Feb. 24, 2009, including an English-language translation.

* cited by examiner

LADDER PATTERN 1

HATCHED AREA:Jmax=30A/m OR MORE

LADDER PATTERN 2

LADDER PATTERN 3

SUPERCONDUCTING DEVICE, FABRICATION METHOD THEREOF, AND FILTER ADJUSTING METHOD

BACKGROUND OF THE INVENTION

1. Field of the Invention

The present invention relates to a superconducting high-frequency device, and more particularly, to a dual-mode superconducting device applied to front end devices, such as transmission filters or transmission antennas, in mobile communications systems or broadcast systems.

2. Description of the Related Art

Along with recent spread and progress of mobile (cellular) phones, high-rate high-capacity transmission techniques are becoming indispensable. Application of superconductors to base station filters for mobile communications is greatly expected, being promised as providing low loss and high Q value resonance, because superconductors have very small surface resistance as compared with ordinary electric conductors, even at a high-frequency region.

For example, as illustrated in FIG. 1C, the RF signal received at the antenna (ANT) 151 is subjected to baseband processing at the baseband processing unit 156, after having passed through the bandpass filter (BPF) 152R, the low-noise amp (LNA) 153, the down converter (D/C) 154, and the demodulator (DEMOD) 155.

In the transmission system, the signal processed by the baseband processing unit 156 passes through the modulator (MOD) 157, the up converter (U/C) 158, the high-power amp (HPA) 159, and the bandpass filter (BPF) 152T, and is finally transmitted from the antenna 151.

When applying a superconductive filter as the receiving-end bandpass filter 152R, a steep frequency cutoff characteristic can be expected with less transmission loss. On the other hand, application to the transmission-end bandpass filter 152T leads to the effect for removing distortion caused by the high-power amp 159. However, the transmission end requires high power to transmit a radio signal, and therefore, simultaneous pursuit of compactness and a satisfactory power characteristic is the present issue.

Conventionally, a resonator is provided with a superconducting filter pattern (signal layer) 102 of a hairpin type illustrated in FIG. 1A, or a straight-line type illustrated in FIG. 1B. See, for example, JP 2001-308603A and JP 3-194979A. The bottom of a dielectric substrate 101 is covered with a superconducting ground film (blanket film) 104, while the top face is furnished with a hairpin or straight-line superconducting filter pattern 102 and a feeder 103.

Conventional filters with the above-described microstrip structure have a problem in that transmission loss increases especially at the transmission end when high RF power is input. This is because a high-frequency wave, such as a microwave, is likely to concentrate on the edge of the conductor pattern, causing concentration of electric current on the edge or the corner of the microstrip line, and because the electric current density exceeds the critical current density of the superconductor.

To overcome this problem, a disk pattern has been proposed to reduce concentration of electric current, as illustrated in FIG. 2A. In this example, a superconducting disk pattern 112 with fewer corners or edges is formed on the dielectric substrate 101 in order to realize a high power response as the transmission filter.

When the filter pattern is formed as a TM11 mode disk resonator, the electric current flows uniformly along the symmetric arcs with respect to the diameter of the disk, as illustrated in FIG. 2B. The magnetic field points in a direction perpendicular to the electric current.

However, a multistage filter or a multistage array antenna with several disk resonators arranged in it has a drawback of increasing the device size.

Then, a superconducting disk pattern 122 with a notch 125 formed on a portion of the circumference of the disk is proposed. By forming the notch 125, the degeneracy of the mutually orthogonal electric and magnetic fields of the mode is lifted to separate the resonate frequency so as to allow the resonator to function as a dual-mode filter. In the example shown in FIG. 3, two types of resonance at lower frequency f1 (with electric current flow in direction A) and higher frequency f2 (with electric current flow in direction B) with respect to the center frequency f0 are generated.

However, the notch 125 formed in the superconducting disk pattern 122 causes the electric current to concentrate on the corners of the notch 125 on the lower frequency f1 side, as illustrated in FIG. 3, resulting in exceeding the maximum electric current density of the basic disk resonator without a notch. In FIG. 3, concentration of electric current occurs in the shaded areas indicated by the arrows. Electric current concentration is conspicuous especially at the bottom edge and the bottom corners of the square-shaped notch 125. In contrast, the area along the circumference of the superconducting disk pattern 122 has less electric current concentration. Frequencies f1 and f2 are 45 degrees out of phase at the maximum electric current density.

Electric current concentration on the corners and edges of the notch 125 will cause a decrease of the maximum allowable power and an increase of distortion in the bandpass filter or the antenna using a superconducting resonator.

Concerning a microstrip type high-frequency transmission line, it is proposed to form a straight groove along the edge of the electrode formed on the dielectric substrate to disperse the electric current concentration on the edge. See, for example, JP 11-177310.

SUMMARY OF THE INVENTION

The present invention is conceived in view of the above-described problems in the prior art, and it is an object of the invention to provide a superconducting device with improved power tolerance and reduced distortion, which can be suitably used for a transmission filter or an antenna.

It is another object of the invention to provide a tuning method for finely tuning the characteristic of a resonant filter of a plane-figure type (e.g., a disk type) formed with a superconductive material.

To achieve the above-described object, in a superconducting resonator pattern of a plane-figure type (such as a disk, an oval figure, or a polygon), at least a portion of the notch, especially an area on which electric current is likely to concentrate, is curved or arc-shaped. The plane-figure type resonator pattern has a two-dimensional expanse, and is distinguished from a line type resonator pattern, such as a hairpin type or a microstrip type.

Depending on the shape of the arced portion, the degree of mutual interference between the electric field and the magnetic field (e.g., the degree of coupling) varies. As the radius of the curvature or the arc increases, concentration of electric current can be reduced more efficiently; however, the coupling of the mode changes and the bandwidth becomes broader. Accordingly, it is desired to set the radius of the curvature of the arced portion of the notch to be at or below a quarter of the effective wavelength ($\lambda/4$).

Alternatively, a second conductor pattern is arranged above the superconducting resonator pattern of the plane-figure type (such as a disk type, an oval type, or a polygonal type) so as to cause a coupling corresponding to the desired bandwidth. Preferably, the second conductor pattern has a curved shape, such as round or oval.

Depending on the size and the position of the second conductor pattern, and on the dielectric constant of a dielectric material between the second conductor pattern and the superconducting resonator pattern, the center frequency and the degree of mutual interference of the electric and magnetic fields of the mode (coupling) vary, causing the bandwidth to change. As the size of the second conductor pattern increases, electric current concentration can be reduced more efficiently; however, coupling of the mode changes and ripple in the pass band increases. Accordingly, it is desired to set the diameter of the round shape or the major axis of the oval shape less than or equal to a quarter of the effective wavelength ($\lambda/4$).

As still another alternative, a ladder pattern is formed in the plane-figure type (such as a disk, an oval, or a polygon) superconducting resonator pattern. The ladder pattern is defined by a notch formed from the periphery of the resonator pattern, and a line-and-space section extending from the notch toward the center of the resonator pattern. The direction of each line of the line-and-space section of the ladder pattern is consistent with direction A in which electric current of lower frequency f1 flows.

Depending on the cutaway amount of the notch, the filter characteristic can be roughly determined. Depending on the line width, the number of lines and the end position of the ladder pattern, the center frequency and the degree of mutual interference of the electric and magnetic fields of the mode (coupling) and the bandwidth can be finely tuned, while reducing electric current concentration.

To be more precise, in one aspect of the invention, a superconducting device includes:

(a) a dielectric substrate; and (b) a plane-figure type resonator pattern made of a superconductive material and formed on the dielectric substrate, the resonator pattern having a notch at least a portion of which is made round or arc-shaped.

By shaping a portion of the notch round or arc-shaped, electric current concentration can be reduced, while maintaining the power characteristic and the frequency characteristic of the device satisfactory.

This superconducting device can operate in two resonant modes in a high-frequency range.

In another aspect of the invention, a superconducting device includes:

(a) a first dielectric substrate;

(b) a plane-figure type resonator pattern formed of a superconductive material on the first dielectric substrate; and (c) a conductor pattern positioned above the resonator pattern so as to generate coupling of a prescribed bandwidth in the resonator pattern.

In still another aspect of the invention, a superconducting device includes:

(a) a dielectric substrate; and (b) a plane-figure type resonator pattern formed of a superconducting material on the dielectric substrate, wherein the resonator pattern has a ladder pattern consisting of a notch formed in portion of a periphery of the resonator pattern and a line-and-space section extending from the notch.

In yet another aspect of the invention, a filter adjusting method for a dual-mode superconducting filter device having a plane-figure type resonator pattern with a notch formed in a periphery of the resonator pattern is provided. The method includes the steps of:

(a) forming a line-and-space section by laser trimming in the resonator pattern such that the line-and-space section extends from the notch and that each line of the line-and-space section extends in a tangential direction of the resonator pattern; and (b) making fine adjustment of a filtering characteristic of the superconducting filter device by controlling a line width of the line-and-space section and/or an end position of the line-and-space section.

BRIEF DESCRIPTION OF THE DRAWINGS

Other objects, features, and advantages of the present invention will become more apparent from the following detailed description when read in conjunction with the accompanying drawings, in which.

DETAILED DESCRIPTION OF THE PREFERRED EMBODIMENTS

The preferred embodiments of the present invention are described below with reference to the attached drawings.

First Embodiment

A superconducting high-frequency device (which may be referred to simply as a "superconducting device") according to the first embodiment of the invention is described in conjunction with FIG. 4 through FIG. 9.

Figure 4A:
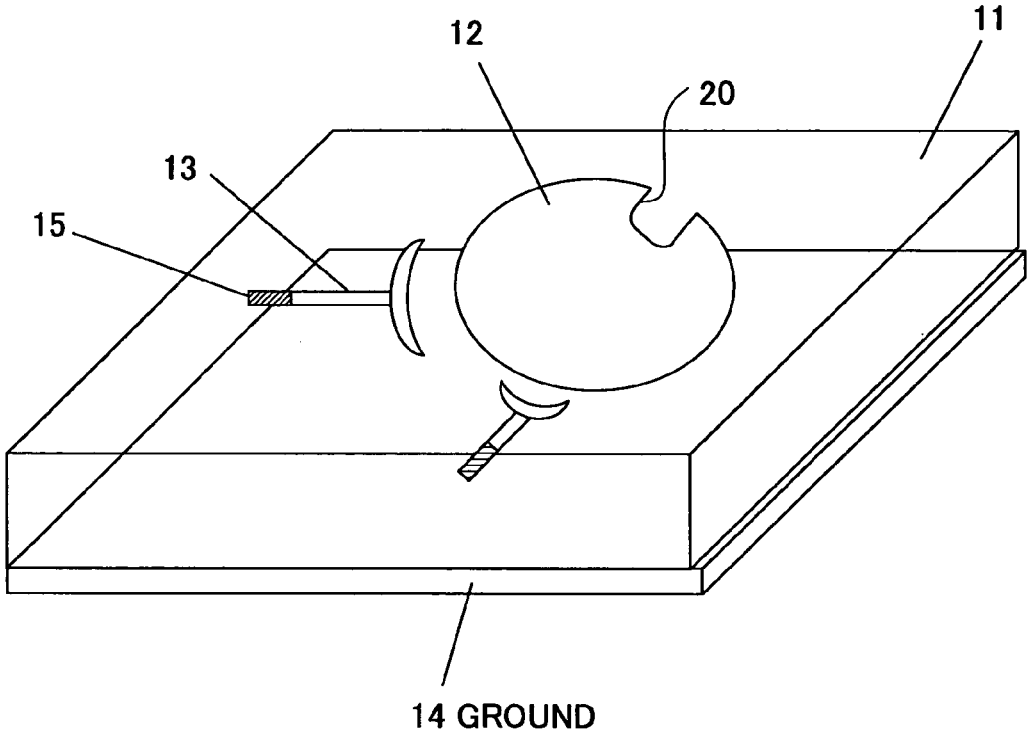
FIG. 4A and FIG. 4B are schematic diagrams of a superconducting device according to the first embodiment of the invention.
Figure 4B:
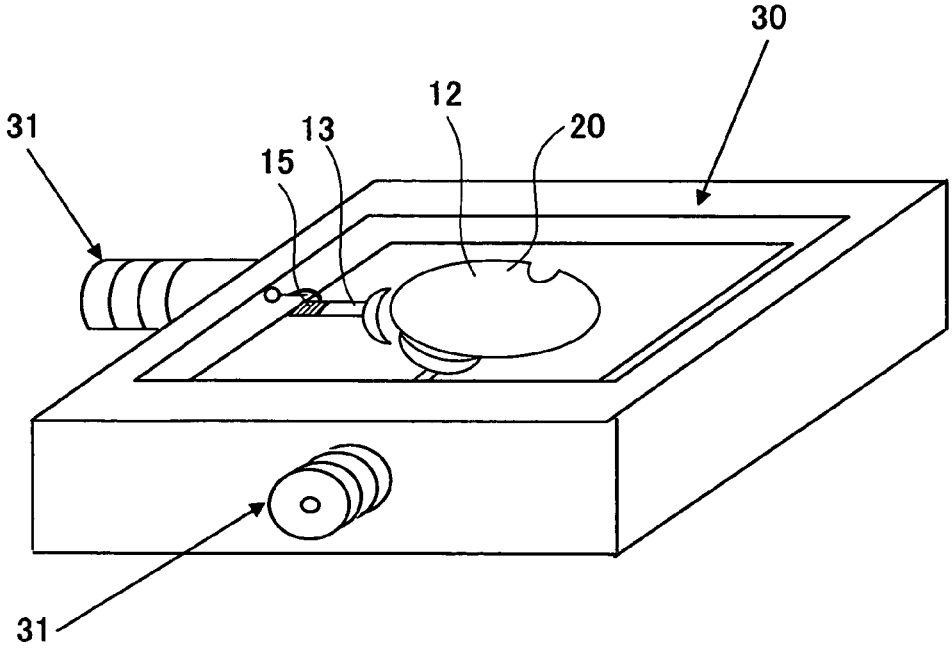

FIG. 4A is a schematic diagram of the superconducting device, and FIG. 4B illustrates an application of the superconducting device to a transmission filter used at a base station in a mobile communications system, which device is accommodated in a metal package 30.

The superconducting device comprises a dielectric substrate (such as a single-crystal MgO substrate) 11, (FIG. 4A) a superconducting resonator pattern (or filter pattern) 12 formed in a prescribed shape on the top face of the MgO dielectric substrate 11, signal input/output lines (feeders) 13 extending toward the superconducting resonator pattern 12, and a ground electrode 14 (FIG. 4A) covering the rear face of the MgO dielectric substrate 11, In this example, a YBCO (Y—Ba—Cu—O) based material is used as the superconductive material.

The superconducting resonator pattern 12 is a plane-figure pattern (disk patter) with a notch 20. At least a portion of the notch 20 is shaped in an arc. The notch 20 produces resonant frequencies of two modes through coupling. In this context, the "plane-figure" pattern is a circuit pattern for defining a basic shape of the resonator and extending in a two-dimensional plane, such as a disk pattern, an oval pattern, or a polygonal pattern. The plane-figure pattern is distinguished from a line pattern (or a linear pattern).

As the dielectric substrate 11, an arbitrary dielectric substrate may be used, other than the single-crystal MgO substrate, as long as it has a dielectric constant ranging from 8 to 10 in the frequency range of 3 GHz to 5 GHz. One of the feeders 13 extending from the signal input/output electrode 15 toward the superconducting resonator pattern 12 is used for signal input, and the other is used for signal output.

In FIG. 4B, the plane-figure type superconducting device is mounted in the metal package 30 coated with gold, and covered with a top plate (not shown). Input/output connectors 31 are fixed to the metal package 30, and the center conductor of the input/output connector 31 is electrically connected to the electrode 15 coupled to the end of the corresponding feeder 13. The electric connection is realized using any suitable technique, such as wire bonding, tape-automated bonding, or solder bonding. The ground electrode (or ground coat) 14 (FIG. 4A) covering the rear face of the MgO dielectric substrate 11 improves the electric connection with the metal package 30.

Figure 5A:
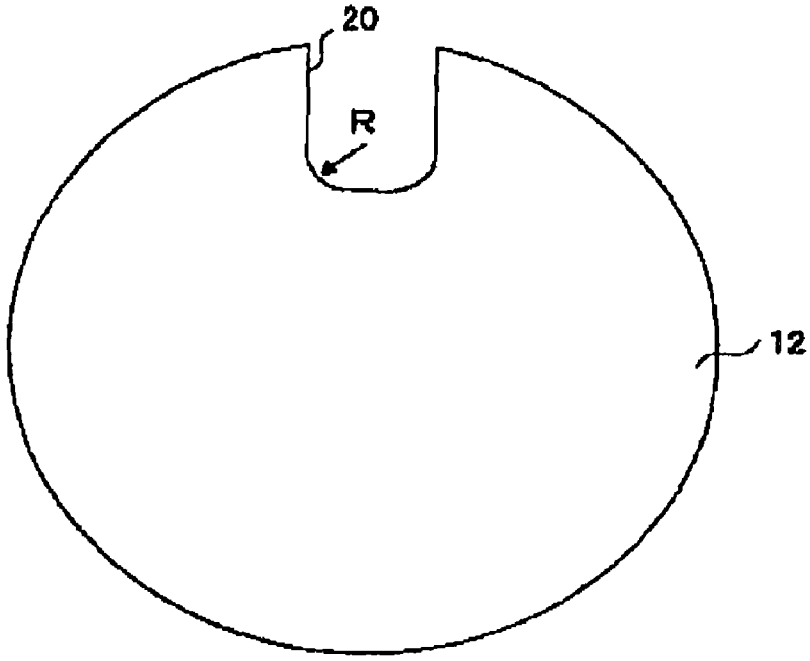
FIG. 5A and FIG. 5B are schematic diagrams illustrating examples of the notch formed in the resonator pattern of the superconducting device according to the first embodiment of the invention.
Figure 5B:
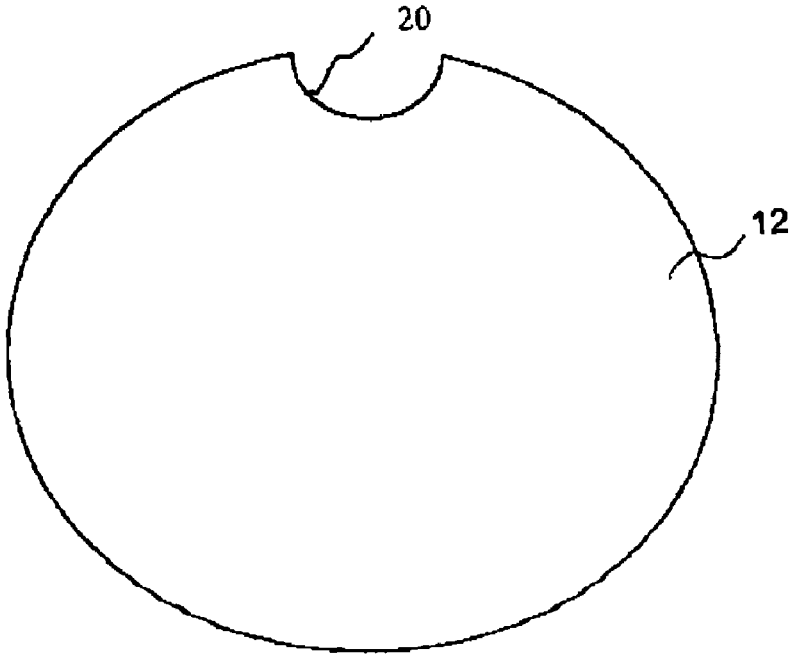

FIG. 5A and FIG. 5*b* are examples of the notch shape formed in the superconducting resonator pattern 12. In FIG. 5A, the notch 20 is U-shaped with round corners. Preferably, the radius R of curvature of the round (or arced) portion is at or below a quarter of the effective wavelength ($\lambda/4$).

In the example shown in FIG. 5B, the notch 20 is defined only by an arc, without a straight portion. Again, the radius R of curvature is at or below $\lambda/4$. These notches 20 are characterized in round cut, in comparison with the conventional square notch.

In fabrication of the superconducting device, for example, a YBCO (Y—Ba—Cu—O) based thin film is formed by laser evaporation on both faces of a MgO substrate, which substrate is to be cut into pieces with dimensions of 20×20×0.5 (mm) in a later process. The thickness of the YBCO-based thin film is appropriately selected according to the filter characteristic, and it is set to, for example, 0.5 μm. The YBCO-based thin film on one side of the MgO substrate 11 is patterned by photolithography to form a resonator disk pattern 12 with a round notch 20 and feeders 13. The diameter of the disk pattern 12 is about 14 mm. Then, a metal electrode 15 is formed at the end of each of the feeders 13. The YBCO-based thin film on the other side of the MgO substrate 11 is left as it is, and used as a ground electrode 14.

The thus-fabricated superconducting device is mounted in the metal package 30 to comprise a resonator. The superconducting device illustrated in FIGS. 4A and 4B has resonant frequencies of two modes orthogonal to each other in the 4 GHz band, and it can be applied to the fourth generation mobile communications systems.

Figure 6A:
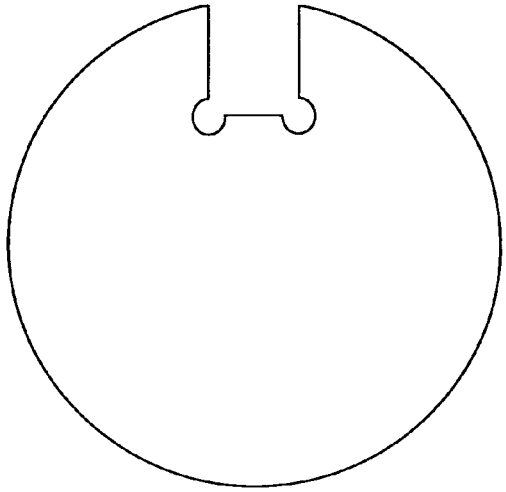
FIG. 6A through FIG. 6C are modifications of the notch formed in the resonator pattern.
Figure 6B:
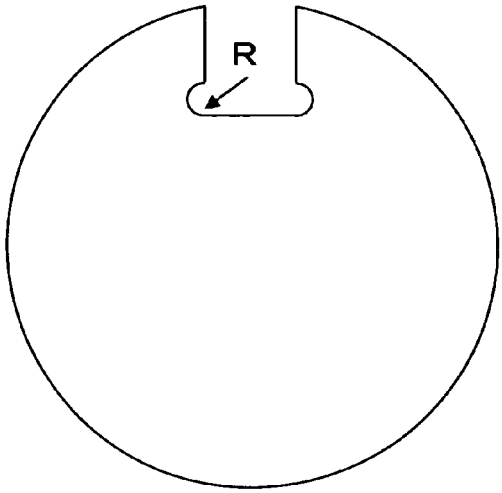
Figure 6C:
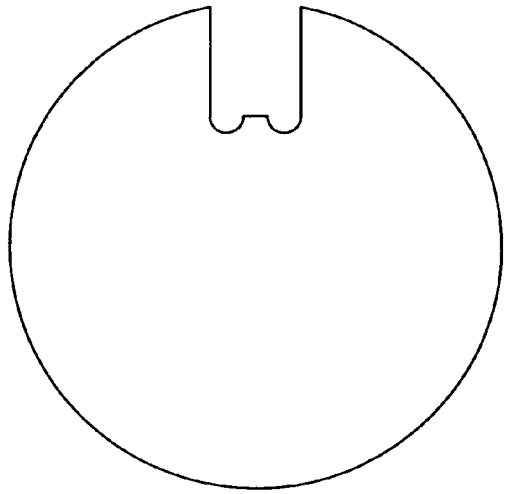

FIG. 6A through FIG. 6C are modifications of the notch shape formed in the superconducting resonator pattern. In these examples, the radius R (e.g., see FIG. 6B) of curvature is at or below $\lambda/4$, and more preferably, at or below $\lambda/8$.

Figure 1A:
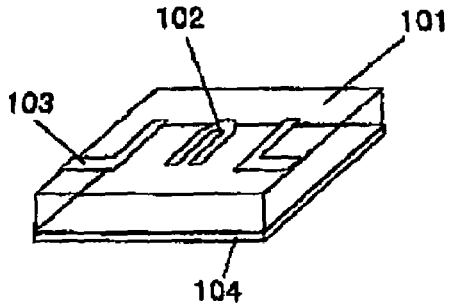
FIG.1A PRIOR ART
FIG. 1A through FIG. 1C illustrate conventional superconducting filters used in the RF front end of a base station in a mobile communications system.
Figure 1B:
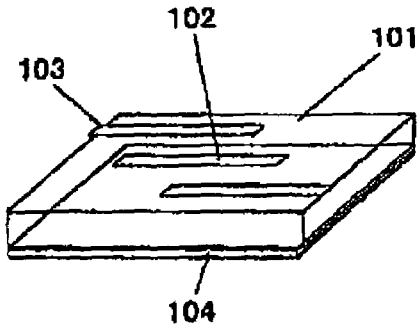
FIG.1B PRIOR ART
Figure 1C:
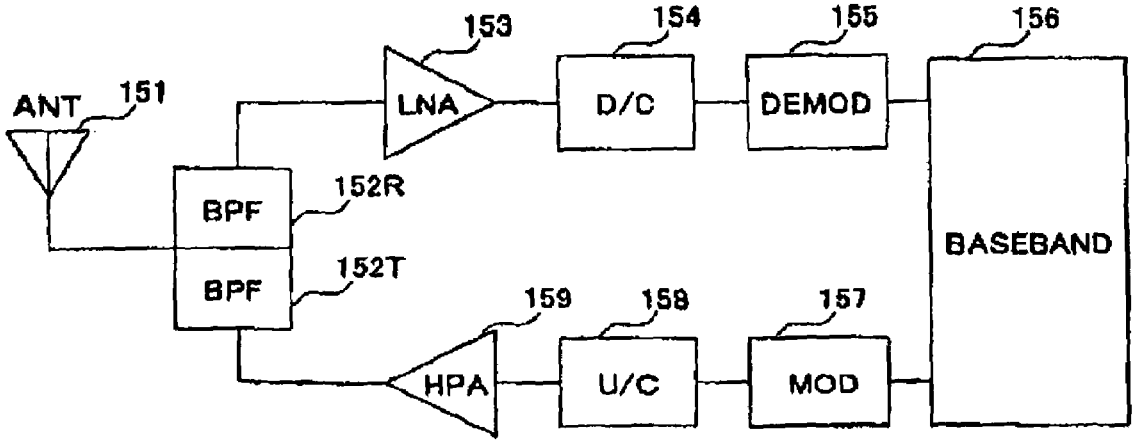
FIG.1C PRIOR ART
Figure 2A:
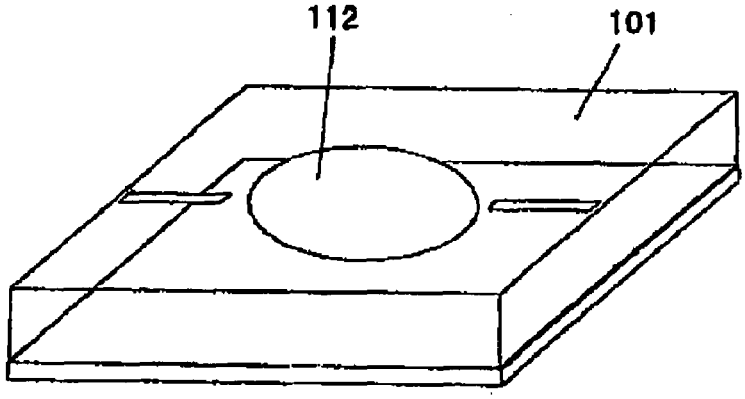
FIG.2A PRIOR ART
FIG. 2A illustrates a conventional disk resonator.
Figure 2B:
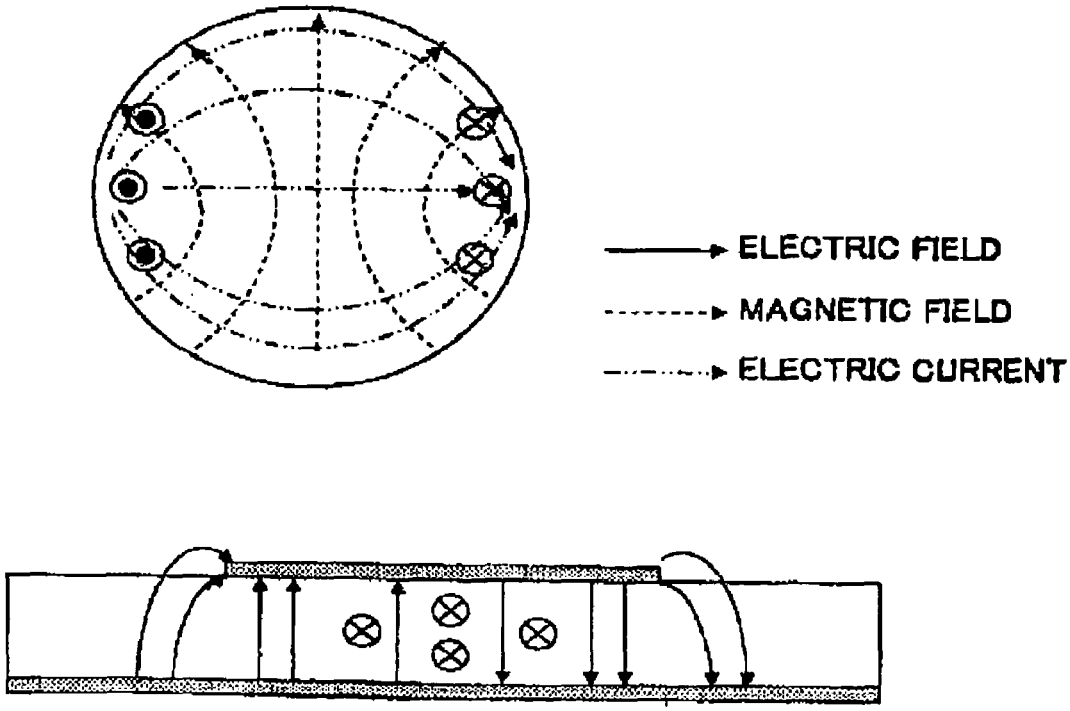
FIG.2B PRIOR ART
FIG. 2B illustrates the current flow and the distribution of the electric and magnetic fields in the TM11 mode.
Figure 3:
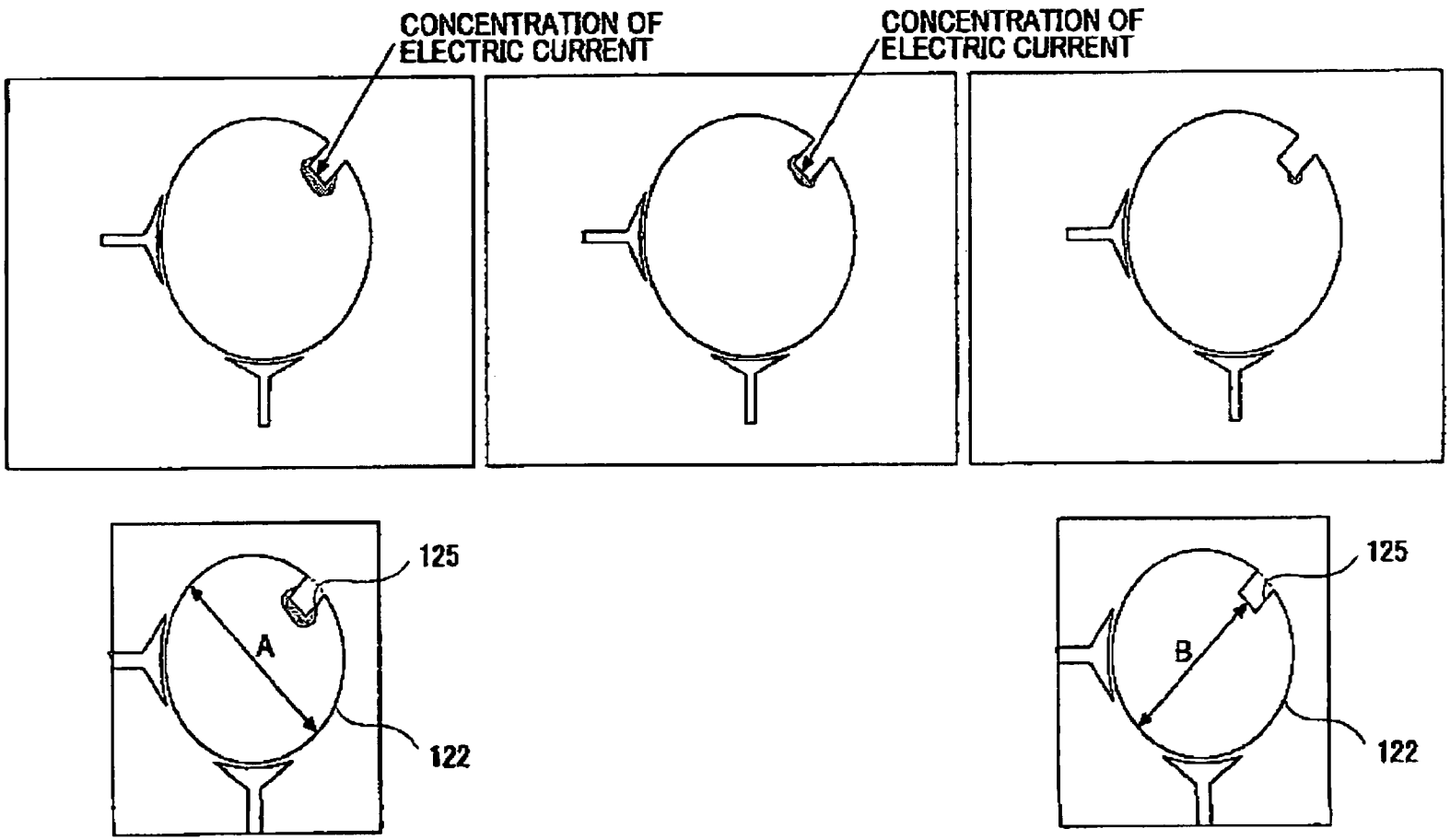
FIG.3 PRIOR ART
FIG. 3 illustrates concentration of electric current density in a conventional notched disk resonator.
Figure 7:
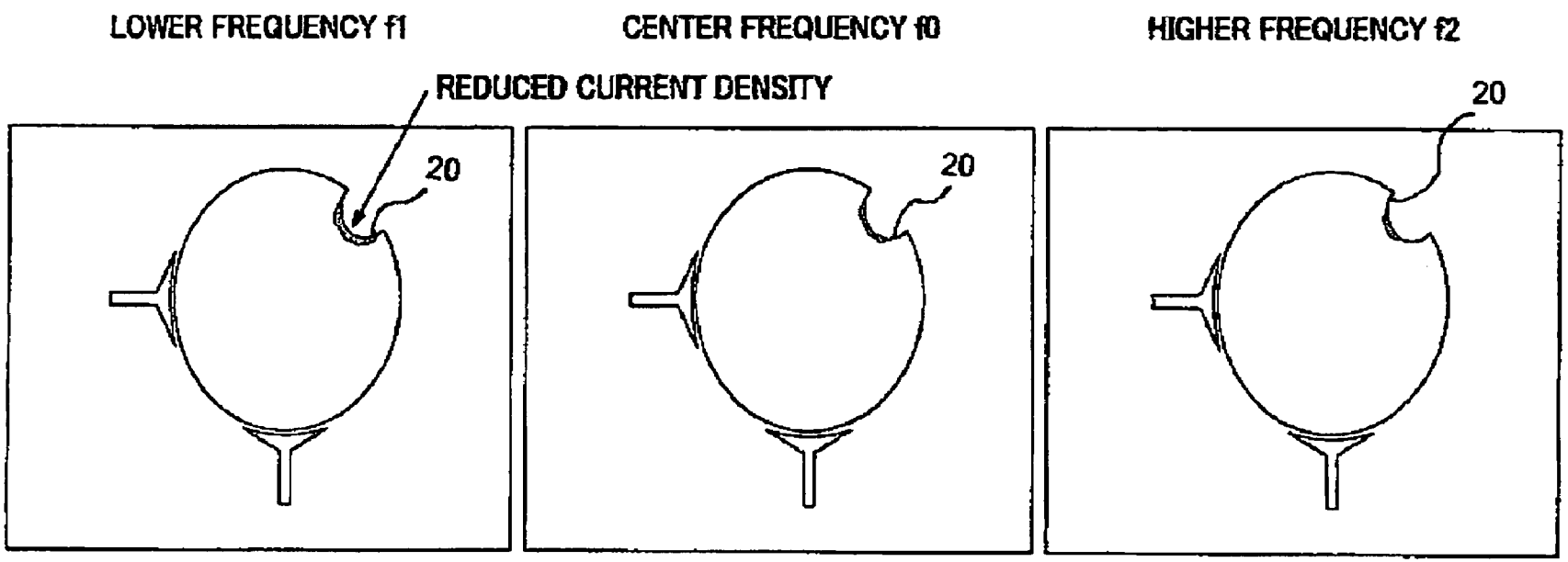
FIG. 7 illustrates the effect of reducing concentration of electric current density according to the first embodiment of the invention.

FIG. 7 is a schematic diagram illustrating the effect of the superconducting resonator pattern of the first embodiment for reducing concentration of electric current density for lower frequency f1, center frequency f0, and higher frequency f2. As indicated by the arrow, concentration of electric current density is greatly reduced around the notch 20 especially on the low frequency (f1) side, as compared with the conventional disk resonator with a squared-shaped notch illustrated in FIG. 3. In the other portion of the disk edge, concentration of electric current density is sufficiently low, as in the conventional disk resonator. Resonant frequencies f1 and f2 are out of phase by 45 degrees.

Figure 8:
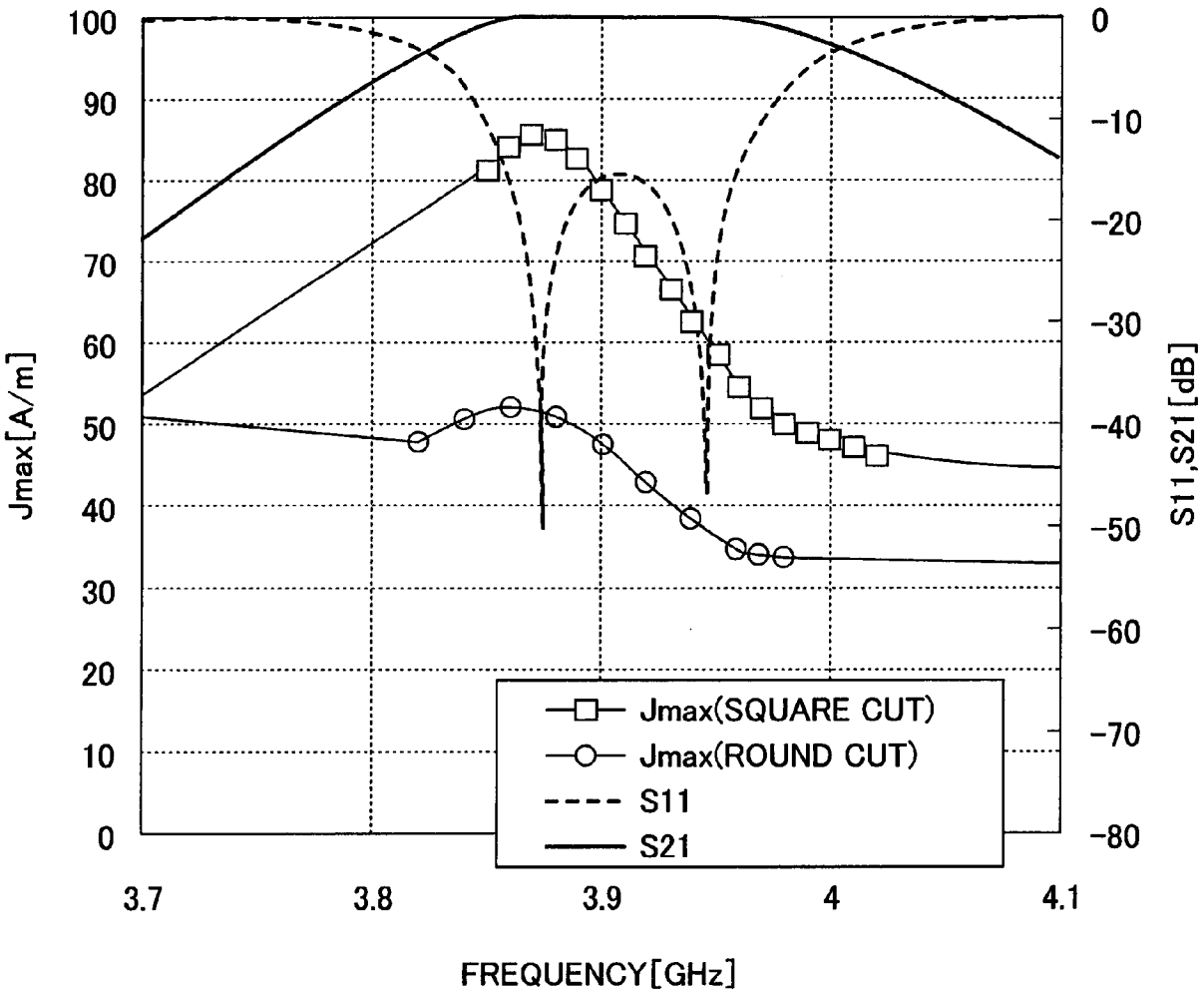
FIG. 8 is a graph showing the effect of the first embodiment in comparison with a conventional notched disk resonator.

FIG. 8 is a graph showing the reduction of electric current density concentration, together with the frequency characteristics of the superconducting device of the first embodiment. In FIG. 8, the maximum electric current density Jmax of the conventional disk resonator with a square cut is plotted by white squares as a function of frequency, and the maximum electric current density Jmax of the disk resonator with a round cut of the first embodiment is plotted by white circles as a function of frequency. The solid line and the dashed line represent the transmission characteristic (S21) and the input reflection characteristic (S11), respectively, of the superconducting device of the first embodiment.

As is clearly shown in the graph, by making at least a portion of the notch 20 arced, the maximum electric current density can be reduced greatly, as compared with the conventional disk resonator with a square notch. As indicated by the S11 characteristic, the resonant frequencies of the two modes are clearly shown in the 4 GHz band. This means that the disk resonator of the first embodiment is suitably used as a dual-mode filter or a double filter with satisfactory frequency characteristics.

Figure 9:
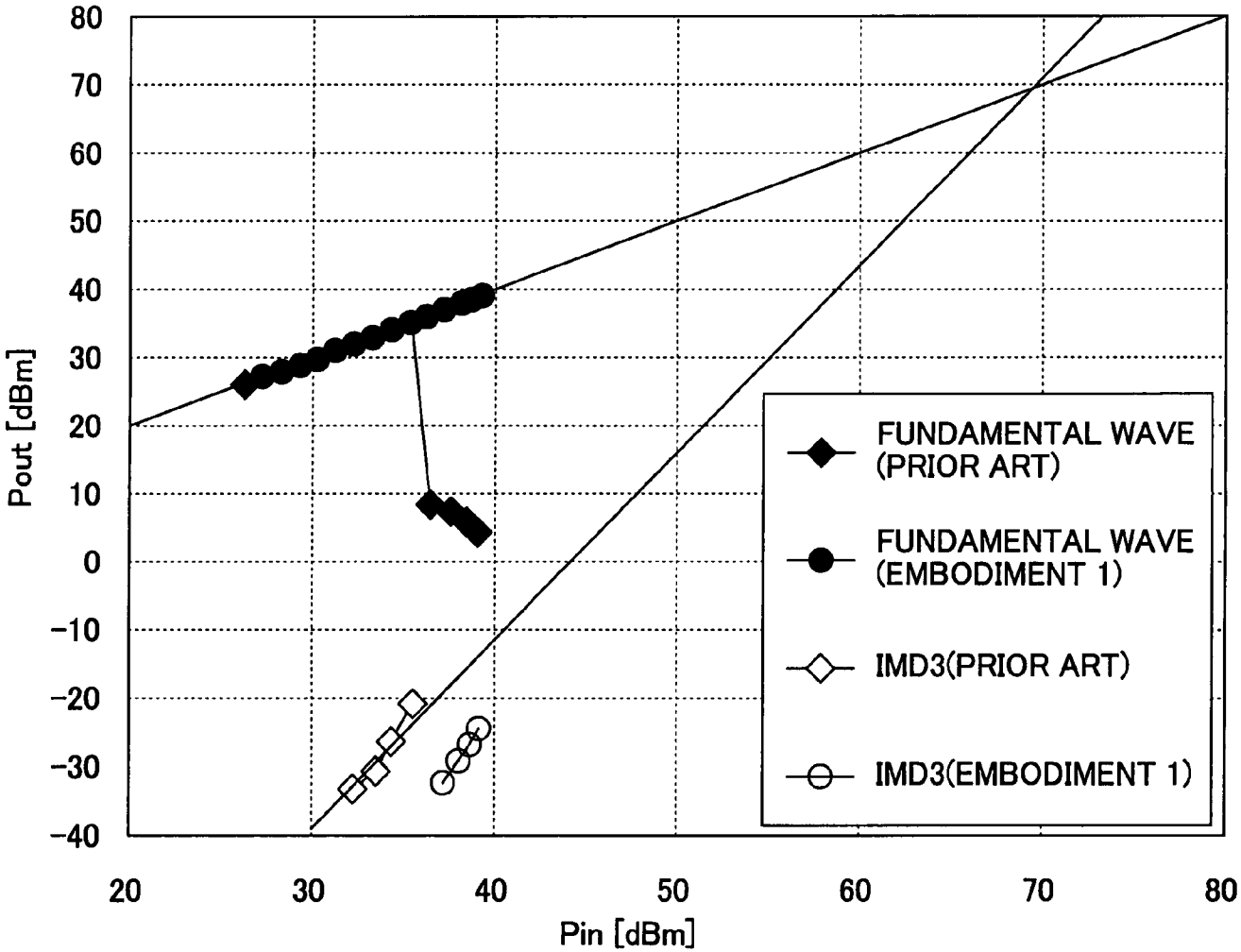
FIG. 9 is a graph showing the power characteristic and the distortion of the superconducting device of the first embodiment in comparison with the conventional device.

FIG. 9 is a graph showing the power characteristic and the distortion characteristic of the superconducting device of the first embodiment. To measure the power characteristic and the distortion characteristic, a sample of a disk resonator with a round-cut notch illustrated in FIG. 5B is prepared, and the sample resonator is mounted in a metal dewar. The dewar is filled with helium gas, and the temperature is varied in the temperature range from −203° C. (70K) to −193° C. (80K). The resonant curves measured at each temperature are ones (S11 and S21) shown in the graph of FIG. 8. Under this condition, output power level Pout is measured as a function of input power level Pin to evaluate tolerable (or allowable) power as the RF power characteristic. In addition, the third-order intermodulation distortion (IMD3) is also measured to evaluate the distortion characteristic.

As the power level is increased in the dual mode at resonant frequencies f1 and f2, the quench phenomenon occurs at −195.9° C. (77.3K) in the conventional disk resonator with a square-notched superconductor pattern. That is, the output power level abruptly falls near 33.6 dBm at the lower frequency f1 as the input power level is increased, as plotted by the dark diamonds, and loss increases greatly.

In contrast, with the round-cut resonant pattern of the embodiment, tolerable power level at or above 40 dBm can be achieved, without causing quench, as plotted by the dark circles.

As to the measurement of IDM 3, two waves are applied near the resonant frequencies f1 and f2 within as close range as 1 MHz to measure the third-order intermodulation distortion caused by the non-linear response of the resonator. The IDM3 of the conventional square-notched superconductor pattern is indicated by white diamonds, and that of the round-cut resonant pattern of the embodiment is indicated by the white circles. As is clearly shown in the graph, by shaping at least a portion of the notch formed in the superconducting resonator pattern in the form of arc, the third-order intermodulation distortion can be reduced by about 10 dBm, as compared with the conventional square-notched superconducting resonant pattern.

With the first embodiment, the maximum tolerable (or allowable) power is improved, while reducing distortion, in a superconducting device. Such a superconducting device is suitably applied to transmission resonators, transmission filters, antennas, or other types of front end devices, and a high-performance transmission/receiving front end can be provided in the fields of mobile communications and broadcasting.

Although it is preferable for the plane-figure type superconductor pattern to be a disk or a round shape from the viewpoint of reducing corners or edges as much as possible, a polygonal pattern may be used. By making at least a portion of the notch round, a dual-mode resonator can be realized, while reducing electric current concentration.

Second Embodiment

Figure 10:
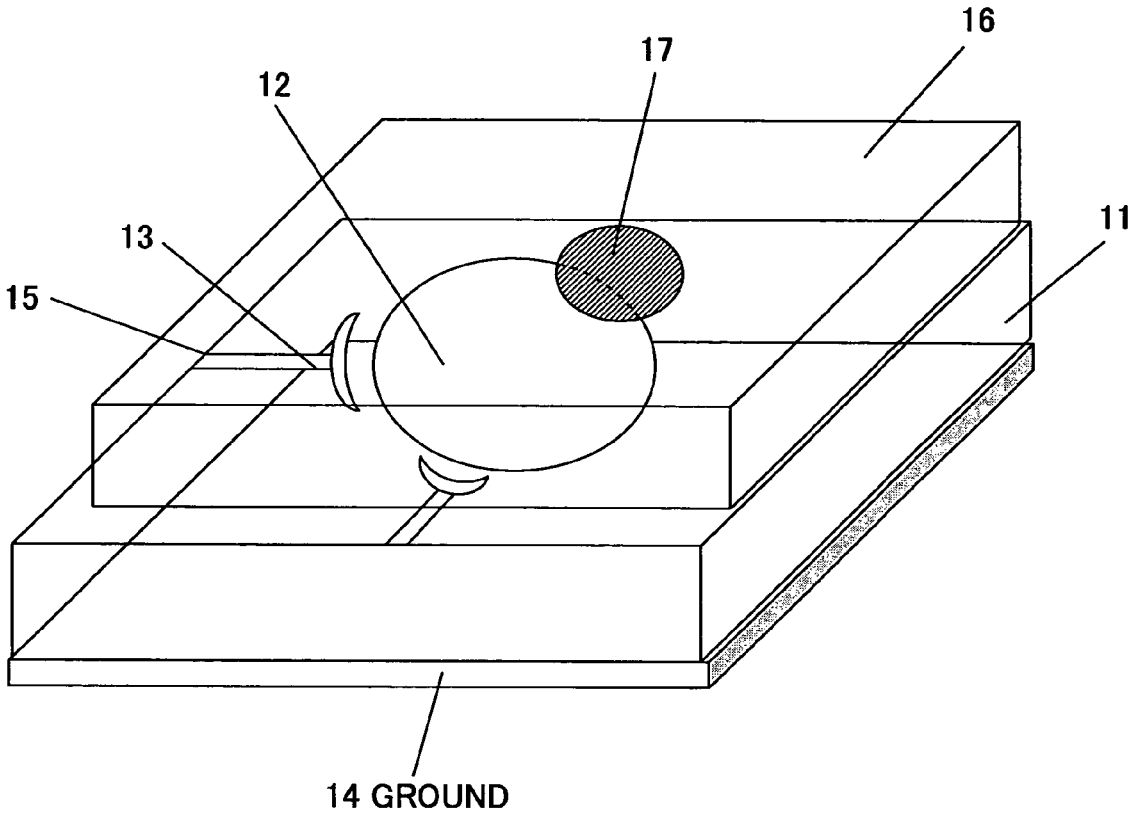
FIG. 10 is a schematic diagram illustrating a superconducting device according to the second embodiment of the invention.
Figure 11:
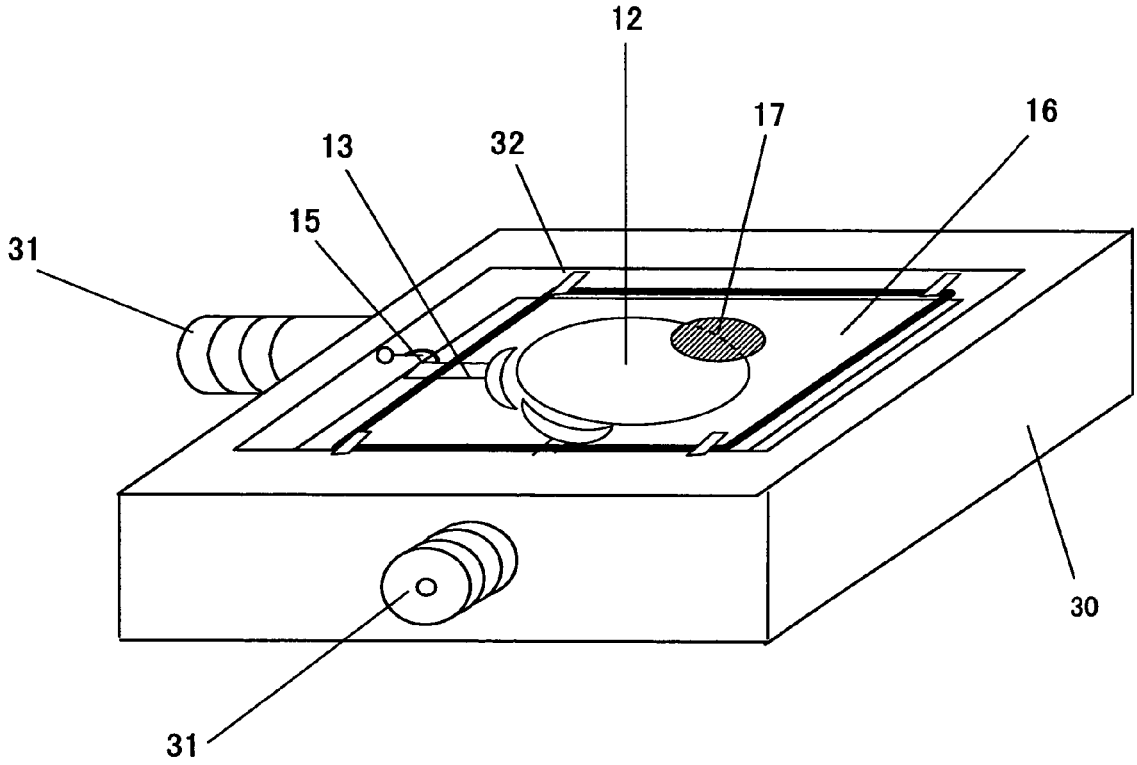
FIG. 11 is a schematic diagram of the packaged superconducting device according to the second embodiment of the invention.

The second embodiment of the invention is described in conjunction with FIG. 10 through FIG. 16. FIG. 10 is a schematic diagram of a superconducting device according to the second embodiment, and FIG. 11 illustrates a packaged device in which the superconducting device shown in FIG. 10 is mounted in a metal package 30 for application to a transmission superconducting filter used at a base station of a mobile communications system.

The superconducting device comprises a dielectric base substrate (such as a single-crystal MgO substrate) 11 (FIG. 10), a superconducting resonator pattern (or filter pattern) 12 formed in a prescribed shape on the top face of the MgO dielectric substrate 11, signal input/output lines (feeders) 13 extending toward the superconducting resonator pattern 12, a ground electrode 14 (FIG. 10) covering the rear Lace of the MgO dielectric substrate 11, a second dielectric substrate 16 placed over the dielectric base substrate 11, and a disk-shaped or oval-shaped conductor pattern 17 formed on the second dielectric substrate 16.

In this example, a YBCO (Y—Ba—Cu—O) based material is used as the superconductive material, and the superconducting resonator pattern 12 is of a plane-figure type formed in a disk pattern.

As in the first embodiment, the plane-figure pattern includes a disk, an ellipse, and a polygon, and is distinguished from a line (or a linear) pattern.

For the dielectric base substrate 11, an arbitrary dielectric substrate may be used, other than the single-crystal MgO substrate, as long as it has a dielectric constant ranging from 8 to 10 in the frequency range of 3 GHz to 5 GHz.

One of the feeders 13 extending from the signal input/output electrode 15 toward the superconducting resonator pattern 12 is used for signal input, and the other is used for signal output.

It is preferable for the dielectric upper substrate 16 to be made of a material with a relatively high dielectric constant and less dielectric loss. For example, MgO, LaAlO3, sapphire, CeO2, and TiO2 may be used. When using a material with a dielectric constant greater than that of the dielectric base substrate 11 for the dielectric upper substrate 16, the effective dielectric constant increases, and the resonant frequency of the superconductor pattern shifts to the lower frequency f1 side. To maintain the original resonant frequency, the superconducting resonator pattern has to be made smaller. In other words, the superconducting device can be made compact at the same frequency. It is desired that the size of the dielectric upper substrate 16 be the same as that of the dielectric base substrate 11.

In FIG. 11, the superconducting device with a plane-figure pattern is mounted in the metal package 30 coated with gold, and covered with a top plate (not shown). Input/output connectors 31 are fixed to the metal package 30, and the center conductor of the input/output connector 31 is electrically connected to the electrode 15 coupled to the end of the corresponding feeder 13. The electric connection is realized using any suitable technique, such as wire bonding, tape-automated bonding, or solder bonding. The ground electrode (or ground coat) 14 covering the rear face of the MgO dielectric substrate 11 improves the electric connection with the metal package 30. The dielectric base substrate 11 and the dielectric upper substrate 16 are fixed by a presser bar spring 32 in the metal package 30.

In the example shown in FIG. 10 and FIG. 11, the conductor pattern 17 may be overlapped directly on the superconducting resonator pattern 12. However, inserting a dielectric between the superconducting resonator pattern 12 and the conductor pattern 17 will lead to more improvement in the operational characteristic. Although the embodiment employs a substrate with a high dielectric constant, the substrate may be replaced by an air layer. In this case, the conductor pattern 17 is formed in the top cover (not shown) of the metal package 30 so as to face the superconducting resonator pattern 12. Alternatively, a second dielectric substrate with the conductor pattern 17 formed at the bottom may be held above the dielectric base substrate 11 such that the conductor pattern 17 faces the superconducting resonator pattern 12 via the air layer.

Figure 12:
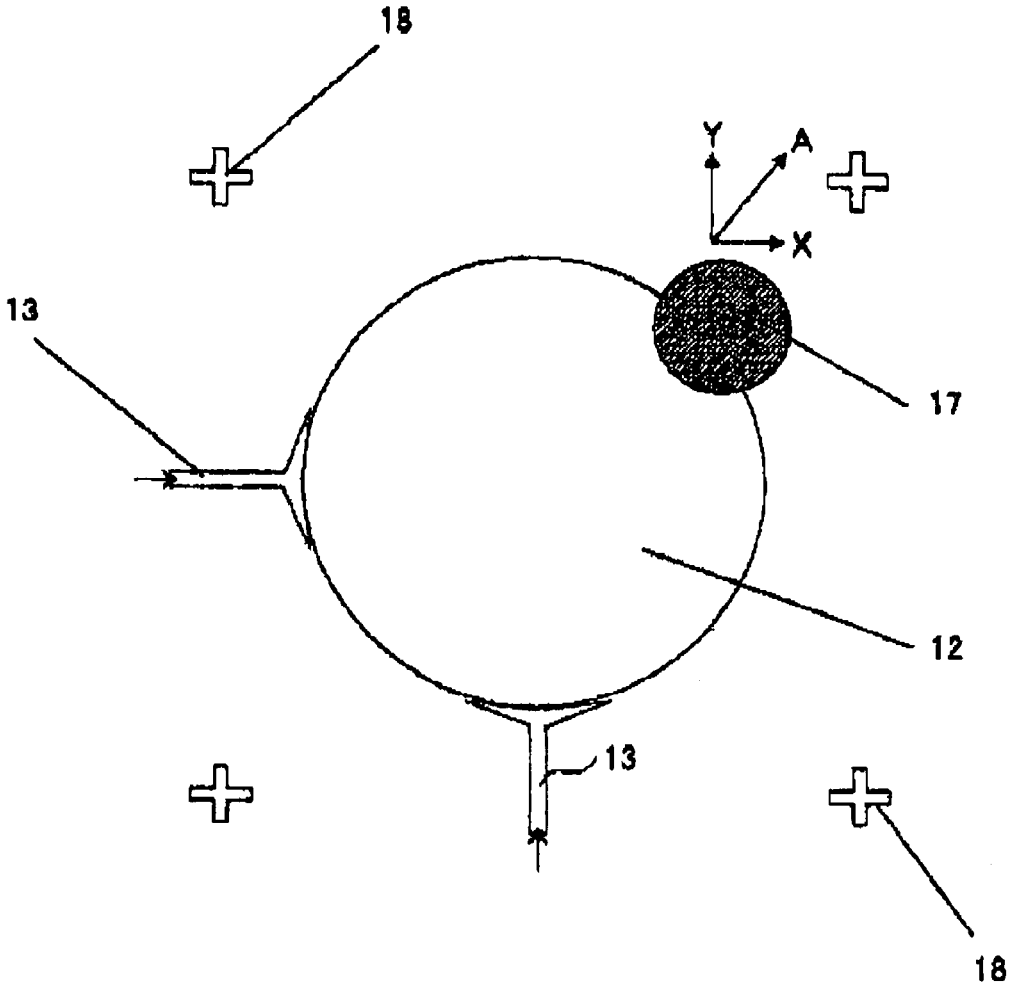
FIG. 12 is a schematic diagram illustrating the positional relation between the resonator pattern and the conductive pattern arranged above the resonator pattern.

FIG. 12 is a plan view of the superconducting device, showing the positional relation between the superconducting resonator pattern 12 and the conductor pattern 17. The conductor pattern 17 is arranged such that the two feeders 13 and the conductor pattern 17 are substantially symmetric with respect to the center of the resonator pattern 12. The conductor pattern 17 is a disk or an ellipse, and the diameter (or the major axis when an ellipse) is at or below a quarter of the effective wavelength ($\lambda/4$).

As the diameter of die conductor pattern 17 increases, concentration of electric current can be reduced; however, if the diameter becomes too large, coupling between the resonant modes of the disk becomes strong, and ripples in the pass band are increased. In addition, the conductor pattern 17 generates resonance and such resonance disturbs the originally determined resonant modes of the disk. To avoid such situations, the diameter (or the major axis if an oval pattern) of the conductor pattern 17 is set less than or equal to a quarter of the effective wavelength ($\lambda/4$).

Depending on the position of the conductor pattern 17, the center frequency and the degree of mutual interference of the modes of the electric/magnetic field (the degree of coupling, that is, the band width) vary. For example, if the conductor pattern 17 is separated from the resonator pattern 12 as indicated by the arrow A, coupling is enhanced and the band width is increased. On the other hand, if the conductor pattern 17 approaches the center of the resonator pattern 12, then coupling is weakened and the band width is narrowed. In order to generate desired dual modes, the position of the conductor pattern 17 is adjusted appropriately so as not to be concentric with respect to the superconducting resonator pattern 12 and so as to produce desired coupling.

In fabrication of the superconducting device, for example, a YBCO (Y—Ba—Cu—O) based thin film is formed by laser evaporation on both faces of a MgO substrate 11. The substrate 11 is to be cut into pieces with dimensions of 20×20×0.5 (mm) after all the necessary layers are formed. The thickness of the YBCO-based thin film is appropriately selected according to the filter characteristic, and it is set to, for example, 0.5 μm. The YBCO-based thin film on one side of the MgO base substrate 11 is patterned by photolithography to form a resonator disk pattern 12 and feeders 13. The diameter of the disk pattern 12 is about 12.8 mm when a $LaAlO_3$ upper substrate 16 is placed over the MgO base substrate 11. Then, a metal electrode 15 is formed at the end of each of the feeders 13. The YBCO-based thin film on the other side of the MgO base substrate is left as it is, and used as a ground electrode 14.

The conductor pattern 17 is formed using a lift-off method in one face of a $LaAlO_3$ single crystal substrate. Alternatively, the conductor pattern 17 may be formed by photolithography and etching after coating the $LaAlO_3$ substrate with a conductive film. Then the substrate is cut into pieces with dimensions of 18×18×0.5 (mm).

The thickness of the conductor pattern 17 is selected so as to reduce the surface resistance. If a metal material is used, a metal film is formed by vacuum evaporation or sputtering such that the thickness is at or above the skin depth. If a superconductive material is used, a superconducting film is formed by laser evaporation, sputtering, or an MBE method such that the thickness is at or above the magnetic penetration depth. When using a metal material, a conductor pattern 17 containing Ag, Cu or Au is formed on the dielectric upper substrate 16 via a glue layer (not shown) made of chromium (Cr) or titanium (Ti) in order to achieve satisfactory adhesiveness between the conductor pattern 17 and the dielectric substrate 16. Since the surface resistance of the glue layer is greater than that of the conductor pattern 17, the thickness of the glue layer is set to or below 0.1 μm. When using a superconductive material, it is desired to form the film under the same conditions as the disk resonator pattern 12 for consistency in characteristics.

The thus-fabricated superconducting device is mounted in the metal package 30 to comprise a resonator. Positioning marks (cross marks in this example) 18 are formed at four corners of the dielectric base substrate 11 and the dielectric upper substrate 16, as illustrated in FIG. 12. By arranging the positioning marks 18 at the four corners, influence on the resonator pattern 12, the conductor pattern 17, and the feeders 13 can be minimized. The positioning marks 18 are formed in the same process as forming the resonator pattern 12, the feeder 13, or the conductor pattern 17. If using a metal material, the positioning marks 18 are formed by a lift-off method on the dielectric base substrate 11, and by lift-off or etching on the dielectric upper substrate 16.

The superconducting device illustrated in FIG. 10 through FIG. 12 has resonant frequencies of two mutually orthogonal modes in the 4 GHz band, and it can be applied to the fourth generation mobile communications systems. Without the conductor pattern 17, the resonator has a single mode with complete orthogonality. By arranging the conductor pattern 17 above the superconducting resonator pattern 12, the orthogonality is partially released, and coupling modes are generated unless the conductor pattern 17 and the superconducting resonator pattern 12 are in the concentric relation. If, as shown in FIG. 12, the conductor pattern 17 is symmetric with respect to an x-axis and a y-axis projected on the pattern, such as an ellipse or a rectangle, dual modes are generated even if the center of the conductor pattern 17 is consistent with the center of the resonator pattern 12. However, it is desired to shape the conductor pattern 17 as a disk or an ellipse for the purpose of preventing concentration of electric current.

Figure 13:
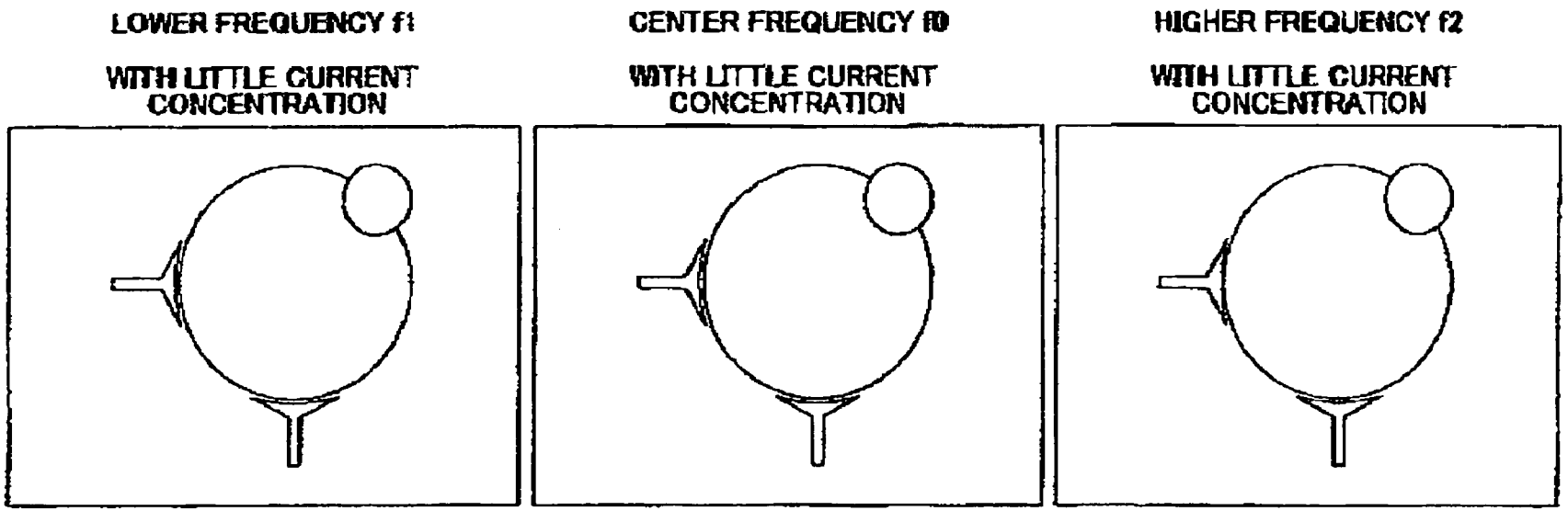
FIG. 13 illustrates the effect of reducing concentration of electric current density according to the second embodiment of the invention.

FIG. 13 is a schematic diagram illustrating the effect for reducing concentration of electric current in the second embodiment. There is little concentration of electric current, and the current density is relatively low over the entire area of the disk pattern 12 at low frequency f1, center frequency f0, and high frequency f2. As compared with the conventional square-notched disk pattern (covered with a dielectric) shown in FIG. 3, concentration of electric current is reduced greatly.

Figure 14:
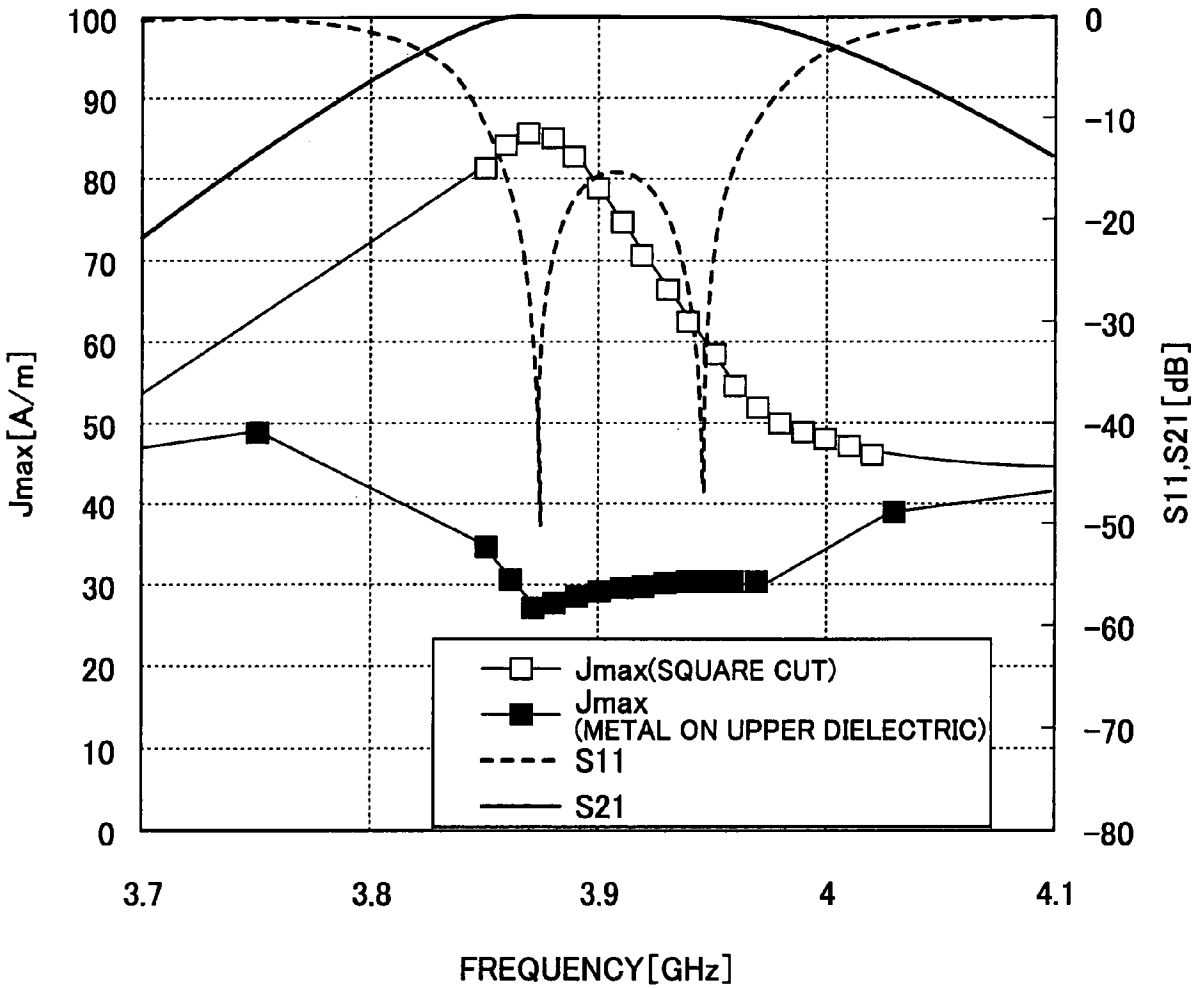
FIG. 14 is a graph showing the effect of the second embodiment in comparison with a conventional notched disk resonator.

FIG. 14 is a graph showing the frequency characteristics and the current concentration reducing effect of the superconducting device of the second embodiment. The maximum current density (Jmax) of the superconducting device of the embodiment is plotted by the dark squares as a function of frequency. As a comparison, Jmax of the conventional square-cut resonator is plotted by white squares as a function of frequency. The input reflecting characteristic (S11) and the transmission characteristic (S21) are also indicated by the dashed line and the solid line, respectively.

As is clearly shown in the graph, with a disk conductor pattern 18 arranged above the superconducting resonator pattern 12, the maximum electric current density can be reduced greatly, as compared with the conventional disk resonator with a square cut. As indicated by the S11 characteristic, the resonant frequencies of the two modes are clearly shown in the 4 GHz band. This means that the disk resonator of the second embodiment is suitably used as a dual-mode filter or a double filter with satisfactory frequency characteristic.

Figure 15:
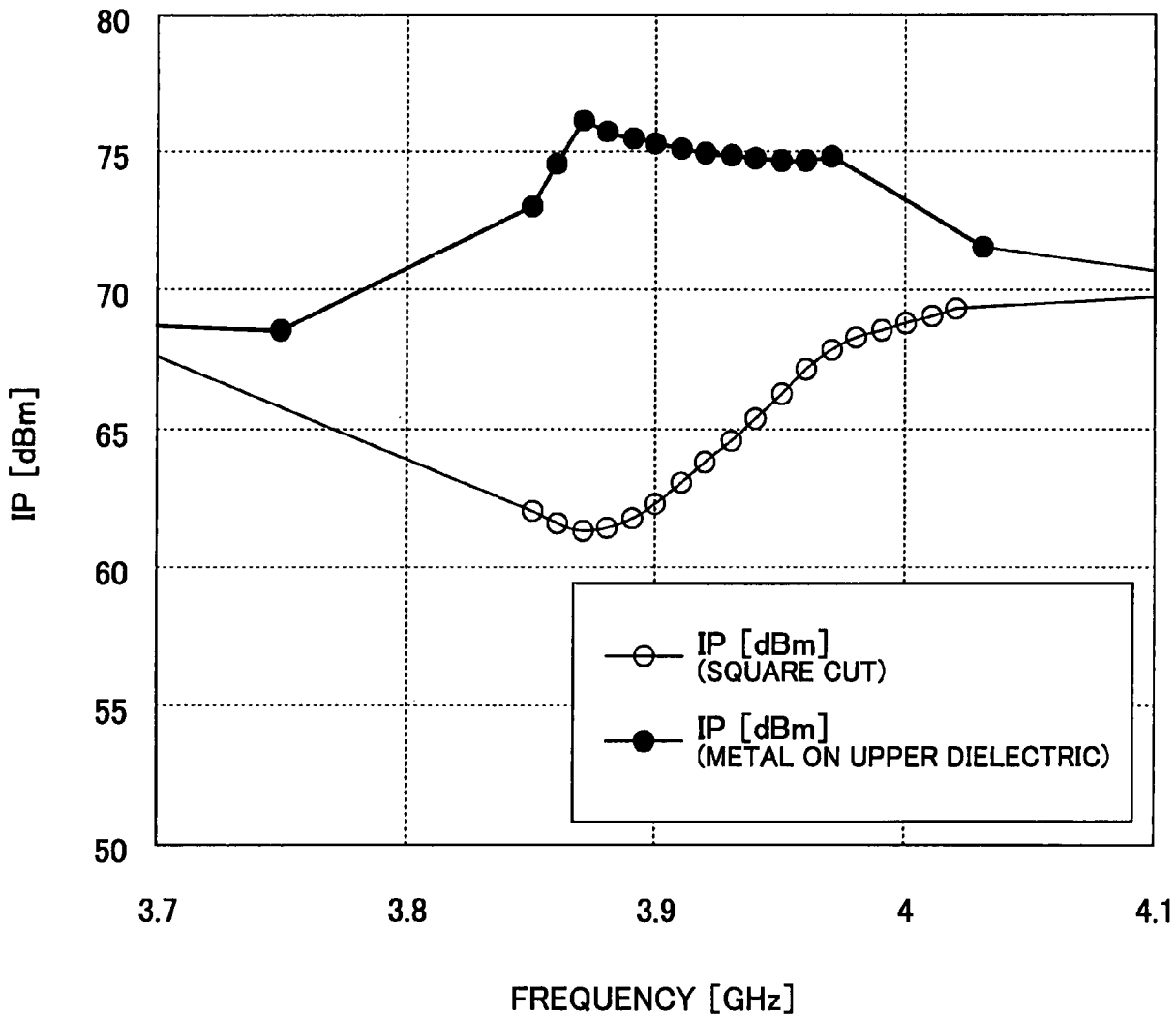
FIG. 15 is a graph showing the maximum tolerable power of the superconducting device according to the second embodiment in comparison with a conventional notched disk resonator.
Figure 16:
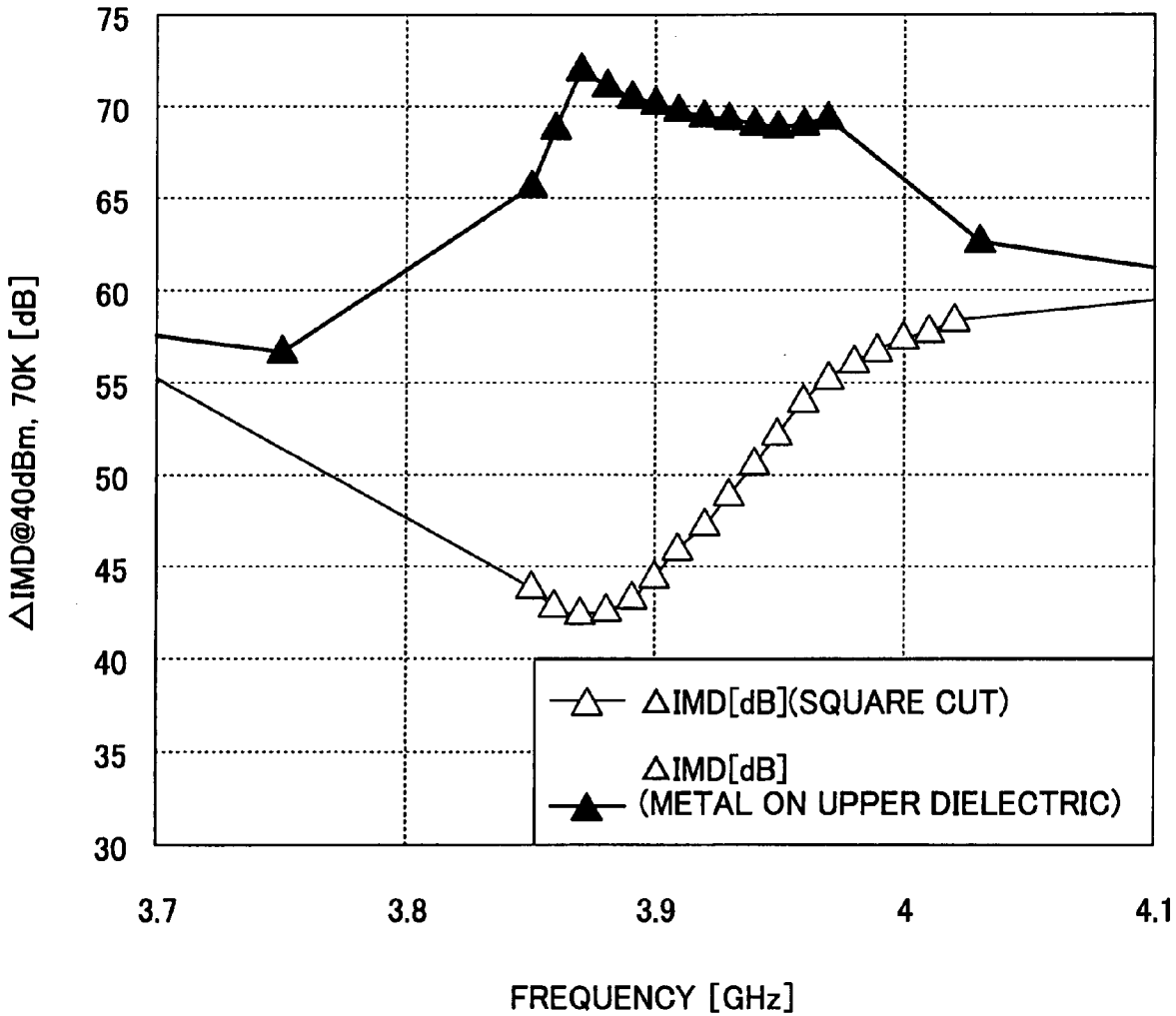
FIG. 16 is a graph showing the improvement in third order intermodulation distortion (IPD3) according to the second embodiment of the invention, in comparison with a conventional notched resonator.

FIG. 15 and FIG. 16 are graphs respectively showing the power characteristic IP [dBm] and the distortion characteristic ΔIMD@40 dBm, 70K [dB] of the superconducting device vs. frequency in [GHz] of the second embodiment. To measure the power characteristic and the distortion characteristic, a sample of a disk resonator with a round-cut notch illustrated in FIG. 5B is prepared, and the sample resonator is mounted in a metal dewar. The dewar is filled with helium gas, and the temperature is varied in the temperature range from −203° C. (70K) to −193° C. (80K). The resonant curves measured at each temperature are ones (S11 and S21) shown in the graph of FIG. 14. Under this condition, output power level is measured as a function of input power level to evaluate tolerable (or allowable) power level as the RF power characteristic. In addition, the third-order intermodulation distortion (IMD3) is also measured to evaluate the distortion characteristic.

From FIG. 15 indicating the IP value representing tolerable power level, it is understood that the power characteristic of the superconducting device with an overlapped conductor pattern of the second embodiment is improved greatly, as compared with the conventional square-cut disk resonator.

From FIG. 16, it can be understood that the third-order intermodulation distortion characteristic indicated along the ordinate of the graph is improved greatly in the second embodiment, as compared with the conventional square-cut disk resonator.

With the second embodiment, the tolerable (or allowable) power level is improved, while reducing distortion, in a superconducting device. Such a superconducting device is suitably applied to transmission resonators, transmission filters, antennas, or other types of frontend devices, and a high-performance transmission/receiving frontend can be provided in the fields of mobile communications and broadcasting.

Third Embodiment

The third embodiment of the invention is described in conjunction with FIG. 17 through FIG. 28. FIG. 17A is a schematic diagrams of a superconducting device according to the third embodiment, and FIG. 17B illustrates packaged device in which the superconducting device shown in FIG. 17A is mounted in a metal package 30 for application to a transmission superconducting filter used at base station of a mobile communications system.

The superconducting device comprises a dielectric substrate (such as a single-crystal MgO substrate) 11 (FIG. 17A), a superconducting resonator pattern (or filter pattern) 12 formed in a prescribed shape on the top face of the MgO dielectric substrate 11, signal input/output lines (feeders) 13 extending toward the superconducting resonator pattern 12, and a ground electrode 14 (FIG. 17A) covering the rear face or the MgO dielectric substrate 11. In this example, a YBCO (Y—Ba—Cu—O) based material is used as the superconductive material.

Figure 17A:
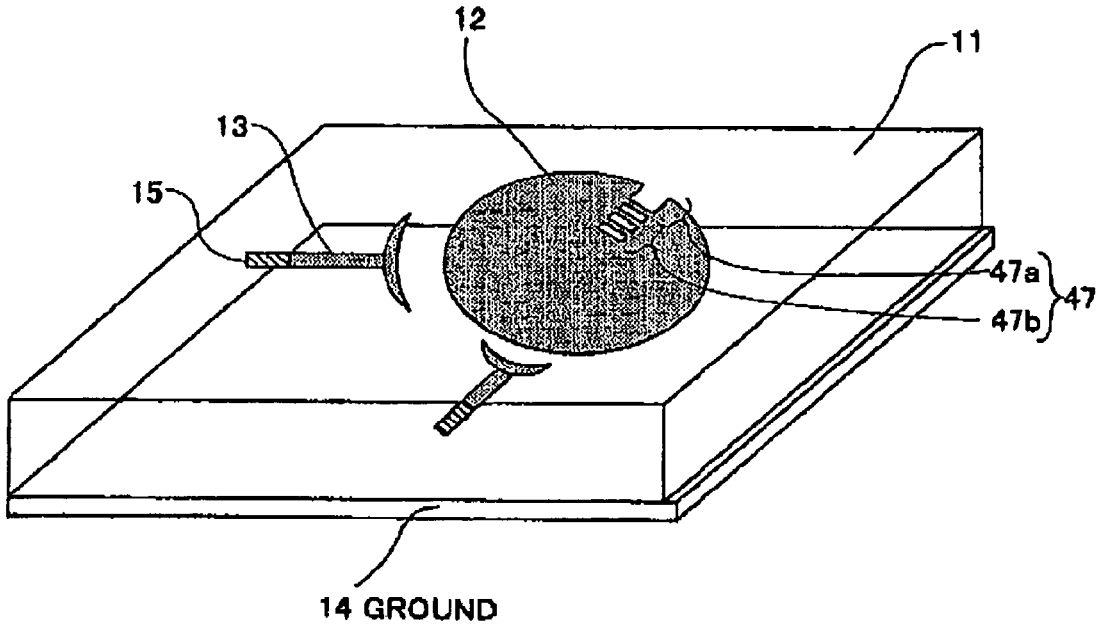
FIG. 17A and FIG. 17B are schematic diagrams illustrating a superconducting device according to the third embodiment of the invention.

As shown in FIG. 17A, the superconducting resonator pattern 12 is of a plane-figure type (a disk type in this example), and it has a ladder pattern 47 extending from the circumference of the disk. The ladder pattern 47 consists of a notch 47*a* cut by a prescribed amount from the circumference of the disk, and multiple lines and spaces (a line-and-space section) 47*b* extending from the end of the notch 47*a*.

As in the previous embodiments, a "plane-figure" pattern defines the basic shape of the resonator extending in a two-dimensional plane, including a disk, an ellipse, and a polygon, and it is distinguished from a "line pattern (or a linear pattern)".

For the dielectric base substrate 11, an arbitrary dielectric substrate may be used, other than the single-crystal MgO substrate, as long as it has a dielectric constant ranging from 8 to 10 in the frequency range of 3 GHz to 5 GHz.

One of the feeders 13 extending from the signal input/output electrode 15 toward the superconducting resonator pattern 12 is used for signal input, and the other is used for signal output.

Figure 17B:
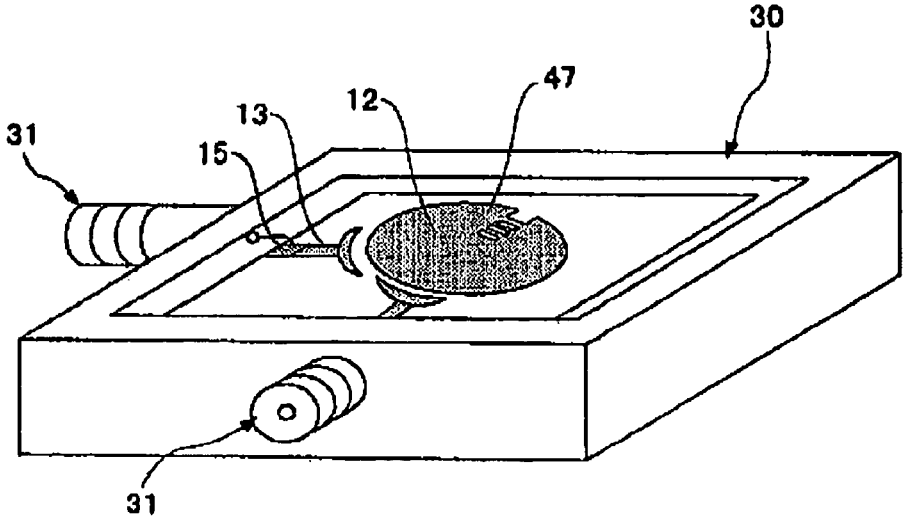

In FIG. 17B, the plane-figure type superconducting device is mounted in the metal package 30 coated with gold, and covered with a top plate (not shown). Input/output connectors 31 are fixed to the metal package 30, and the center conductor of the input/output connector 31 is electrically connected to the electrode 15 coupled to the end of the corresponding feeder 13. The electric connection is realized using any suitable technique, such as wire bonding, tape-automated bonding, or solder bonding. The ground electrode (or ground coat) 14 covering the rear face of the MgO dielectric substrate 11 improves the electric connection with the metal package 30.

Figure 18:
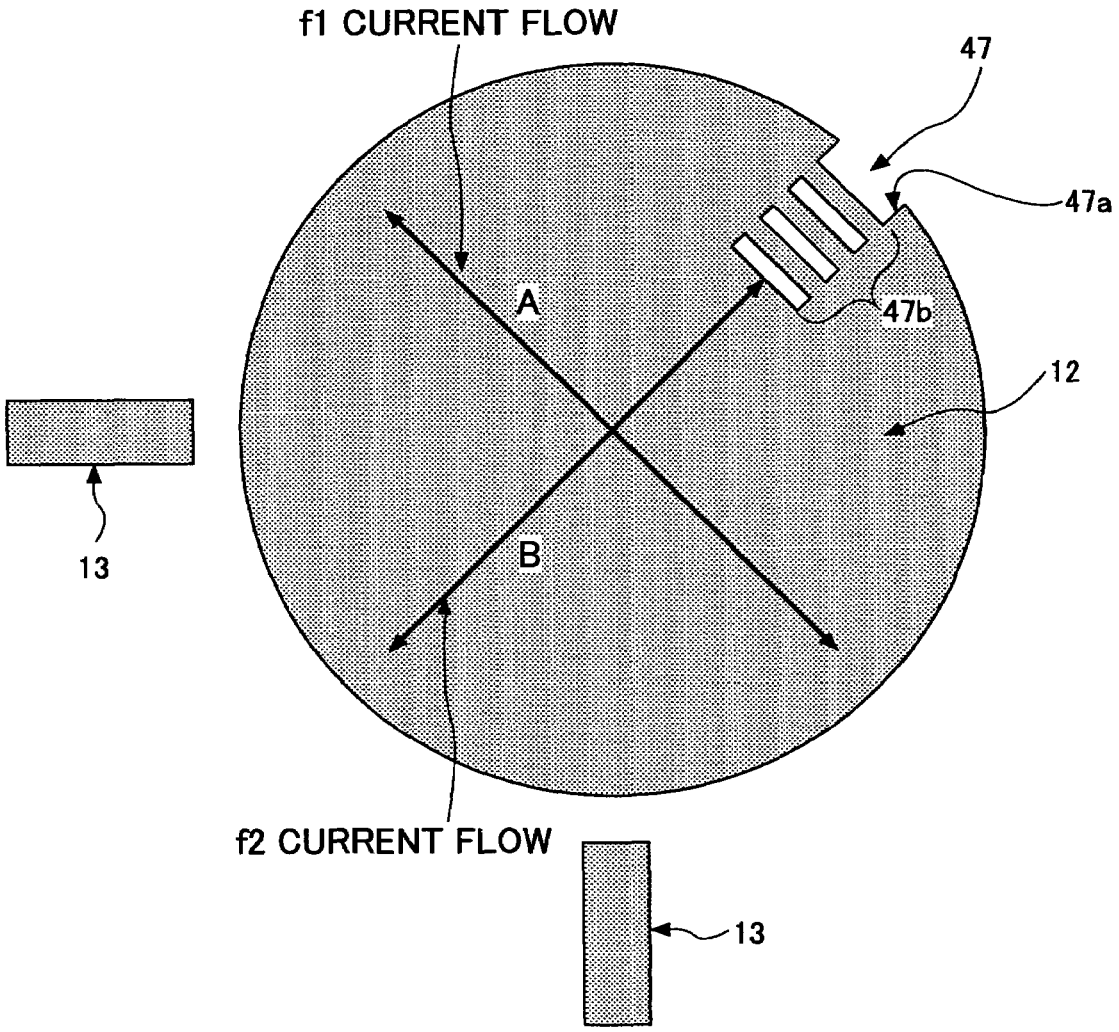
FIG. 18 is a top view of the resonator pattern with a ladder pattern according to the third embodiment of the invention.

FIG. 18 is a top view of the superconducting resonant pattern 12 shown in FIG. 17. The ladder pattern 47 extends from the circumference of the disk pattern 12 toward the center. Each line of the line-and-space section 47*b* extends in direction A of current flow at lower frequency f1. The higher-frequency (f2) current flow B is perpendicular to direction A.

The notch 47*a* of the ladder pattern 47 mainly contributes to coupling of two resonant frequencies, while the line-and-space section 47*b* mainly contributes to reducing concentration of current density and to fine adjustment of the filter characteristics. By controlling the line width and the end position of the line-and-space section 47*b*, the center frequency and the degree of mutual interference of the electric/magnetic field modes (the degree of coupling, that is, the band width) can be adjusted finely.

In the example shown in FIG. 18, the notch 47*a* and the line-and-space section 47*b* are defined by straight lines; however, it is desired to make the corners of the notch 47*a* and the line-and-space section 47*b* arced at a prescribed radius of curvature. In this case, the radius R of curvature of the arced portion is preferably at or below a quarter of the effective wavelength (λ/4). As the radius R of curvature increases, electric current concentration can be more reduced. However, the coupling of the two modes varies, and the band width increases.

In fabrication of the superconducting device, for example, a YBCO (Y—Ba—Cu—O) based thin film is formed by laser evaporation on both faces of a MgO substrate. The substrate is to be cut into pieces with dimensions of 20×20×0.5 (mm) after the formation of all the necessary layers. The thickness of the YBCO-based thin film is appropriately selected according to the filter characteristic, and it is set to, for example, 0.5 μm. The YBCO-based thin film on one side of the MgO substrate 11 is patterned by photolithography to form a resonator disk pattern 12 having the ladder pattern 47 and feeders 13. The ladder pattern 47 may be formed simultaneously with the disk resonator pattern 12 using a mask, or alternatively, it may be formed after the formation of the disk resonator pattern 12, by ion milling using argon (Ar) gas. The diameter of the disk pattern 12 is about 12.8 mm, and the line width of the ladder pattern 47 is about 100 μm.

Then, a metal electrode 15 is formed at the end of each of the feeders 13. The YBCO-based thin film on the other side of the MgO substrate 11 is left as it is, and used as a ground electrode 14.

The thus-fabricated superconducting device is mounted in the metal package 30 to comprise a resonator, as illustrated in FIG. 17B. The superconducting device illustrated in FIG. 17 and FIG. 18 has resonant frequencies of two modes orthogonal to each other in the 4 GHz band, and it can be applied to the fourth generation mobile communications systems.

Even after the completion of the superconducting device (e.g., superconducting high-frequency filter) having the resonator pattern 12 with the ladder pattern 47, the center frequency and the coupling characteristics of the device can be adjusted in a simple manner. For example, the line width or the corner shape of the ladder pattern 47 is changed finely by laser trimming, or one or more lines and spaces may. be added by laser trimming after the test operation.

Figure 19:
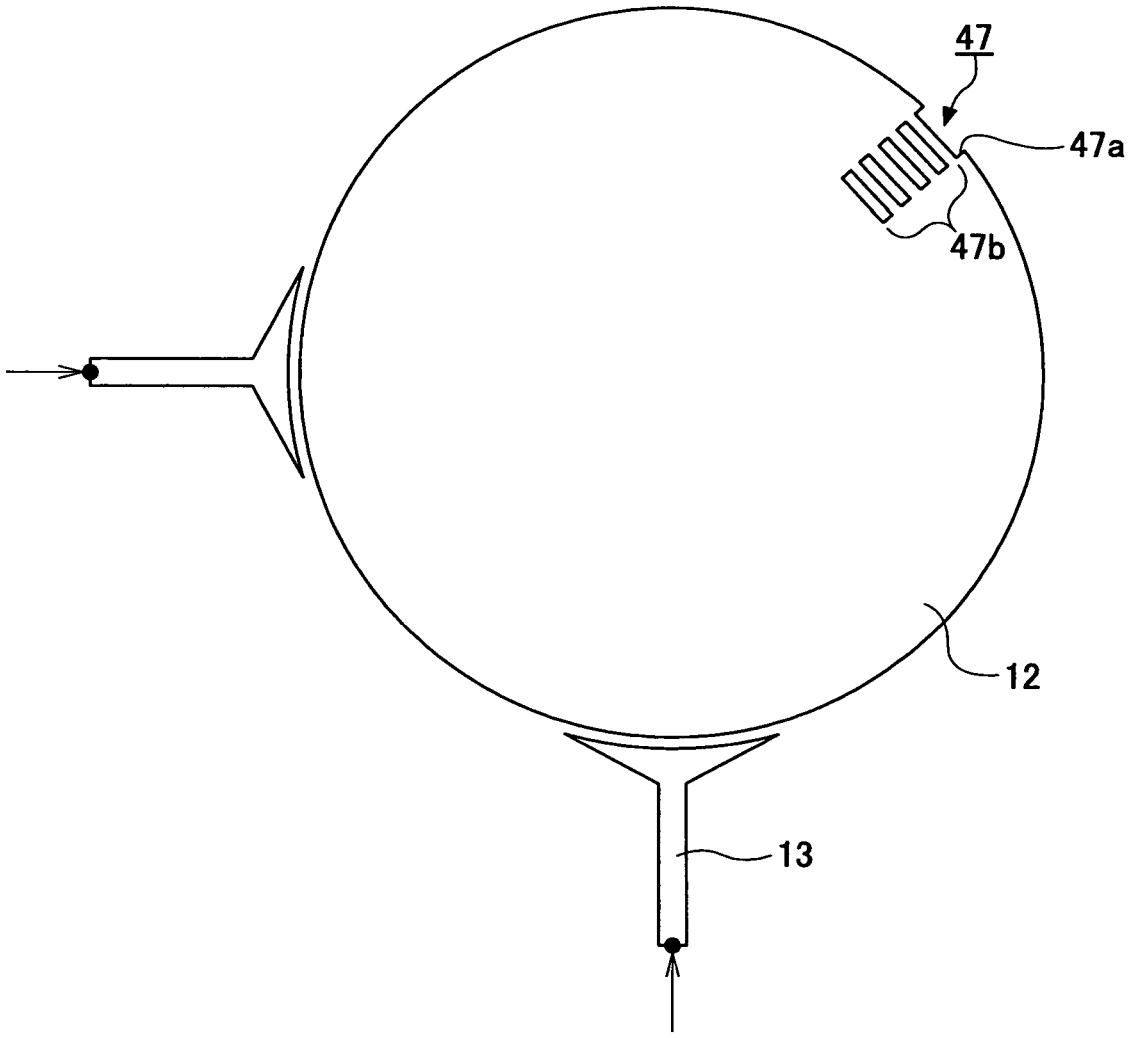
FIG. 19 is a schematic diagram illustrating an example of the ladder pattern (Pattern 1) formed in the disk resonator.
Figure 28:
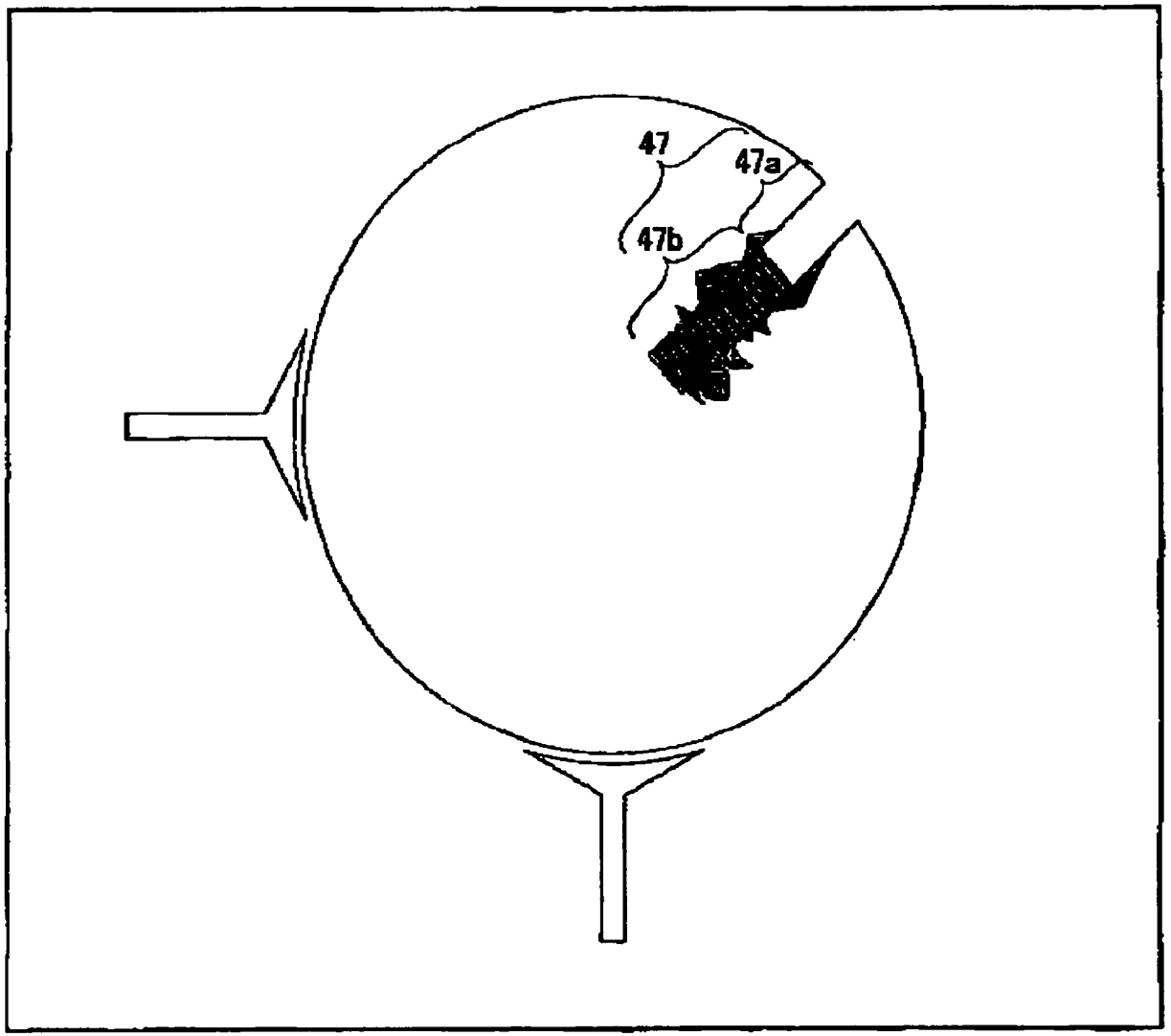
FIG. 28 is a schematic diagram illustrating distribution of electric current density in the disk resonator with ladder pattern 3.

FIG. 19 though FIG. 28 show observation results of electric current concentration and the filter characteristics of disk resonator pattern 12 with different configurations of ladder patterns 47. Signal input/output lines (feeders) are shown at 13. A line-and-space section is shown at 47*b*.

FIG. 19 illustrates a first example of ladder pattern 47 (Pattern 1) formed in the disk resonator pattern 12. In this example, the diameter of the disk pattern 12 is 12.8 mm, the amount of cut from the circumference (that is, the size of the notch 47*a*) is 0.192 mm, and the length of the line-and-space section 47*b* extending from the notch 47*a* in the radial direction is 1.6 mm. Four lines are formed at a line width of 200 μm. The space width between adjacent lines is 200 μm, which width is set below a quarter of the effective wavelength (λ/4). The lateral width in the tangential direction of ladder pattern 47 is about 1 mm.

Figure 20:
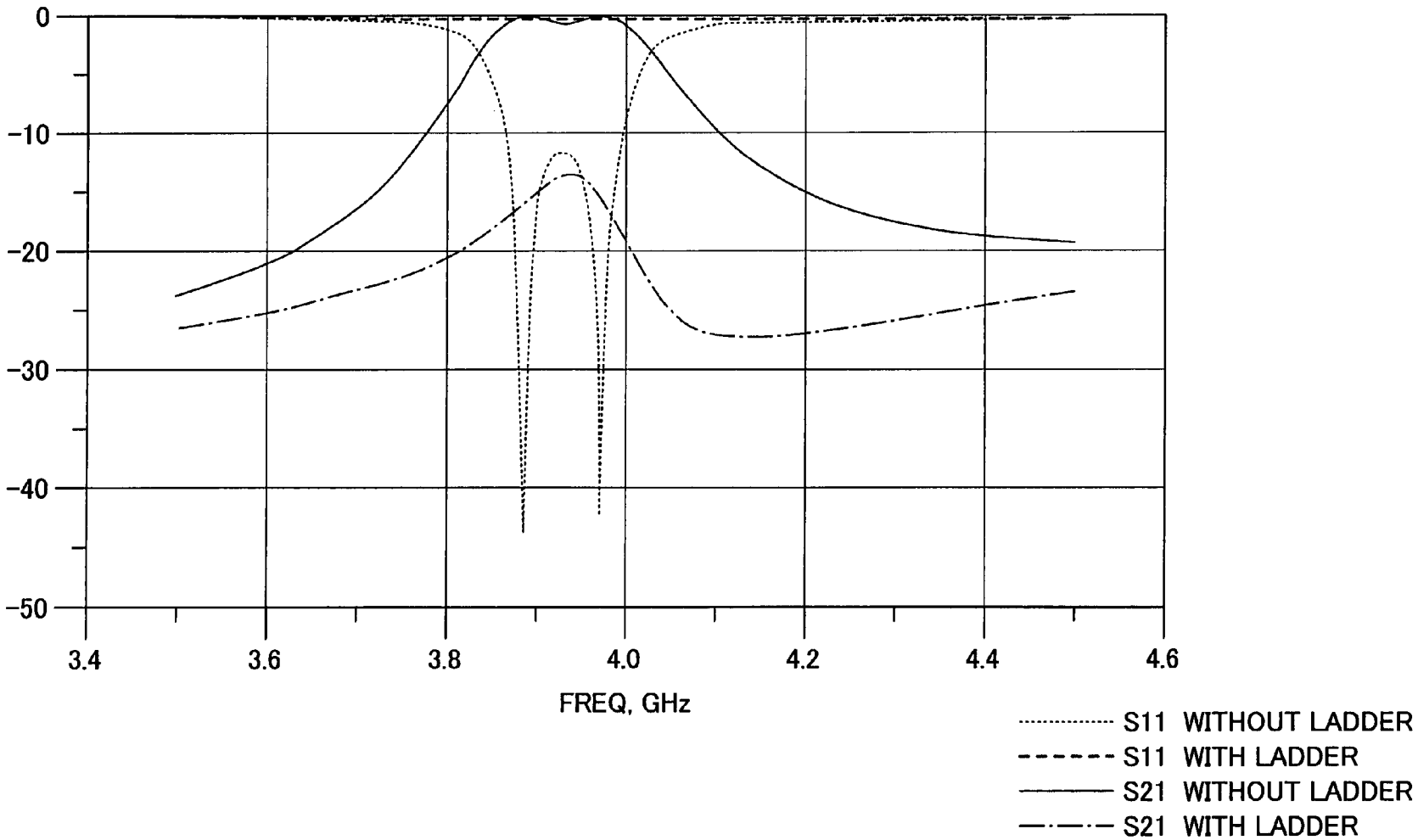
FIG. 20 is a graph showing the filter characteristics of the disk resonator with ladder pattern 1.
Figure 21:
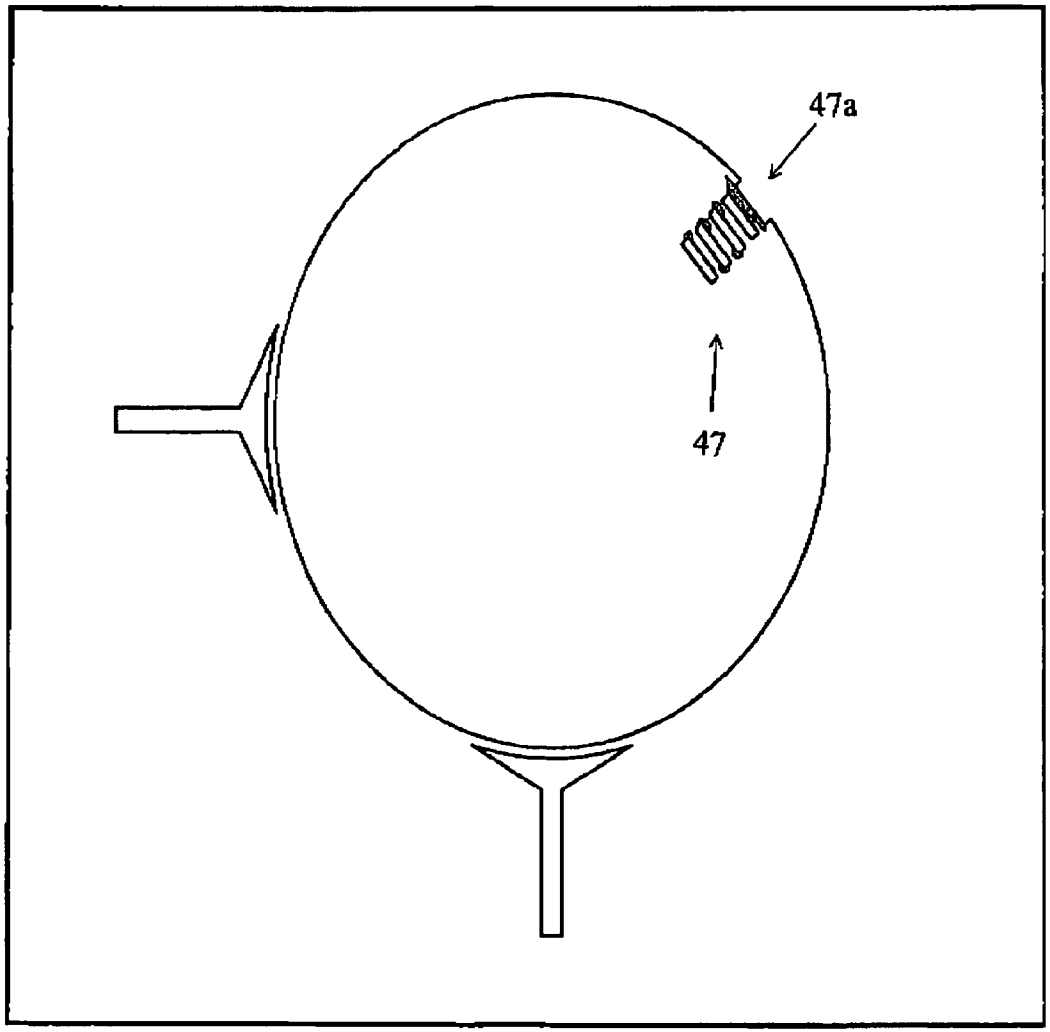
FIG. 21 is a schematic diagram illustrating the distribution of electric current density in the disk resonator with ladder pattern 1.

FIG. 20 is a graph showing the filter characteristics of the resonant filter having the ladder pattern 47 (Pattern 1) shown in FIG. 19, and FIG. 21 is a schematic diagram illustrating distribution of electric current density in the resonant filter with the ladder pattern 47 shown in FIG. 19. The hatched area in FIG. 21 is a region of high current density, in which the maximum current density Jmax is at or more than 30 A/m.

Pattern 1 illustrated in FIG. 19 can reduce electric current concentration very efficiently, as illustrated in FIG. 21; however, this pattern cannot produce different frequencies of two modes, as is clearly illustrated in the graph of FIG. 20. This is because the cut amount (length from the circumference) of the notch 47*a* is insufficient, and therefore, there is little difference from an ordinary disk resonator.

In FIG. 20, the input reflection characteristic (S11) and the transmission characteristic (S21) are plotted as an example of the frequency characteristic of the superconducting resonant filter. The fine dotted line represents the input reflection characteristic (S11) of the filter pattern with an ordinary square notch (without ladder pattern 47) whose size is the same as that of the ladder pattern 47. The bold dashed line represents the input reflection characteristic (S11) of the filter pattern with the ladder pattern 47 shown in FIG. 19. With a simple square notch, resonant frequencies of two modes are clearly indicated. In contrast, the ladder pattern 47 whose line-and-space section 47*b* starts near the circumference of the disk pattern cannot produce resonance.

The solid line represents the transmission characteristic (S21) of the resonant filter with an ordinary square notch (without ladder pattern 47), and the dotted dashed line represents the transmission characteristic (S21) of the resonant filter with the ladder pattern 47 shown in FIG. 19. When the amount of cut from the circumference (the size of the notch 47*a*) is insufficient, transmission loss becomes large, and a signal of a specific frequency band cannot be filtered.

It is understood from FIG. 20 and FIG. 21 that the resonator having a ladder pattern 47, as shown in FIG. 21, with a small amount of cut from the circumference (with a small notch 47*a*) does not function as a dual-mode resonant filter though electric current concentration can be reduced efficiently.

Figure 22:
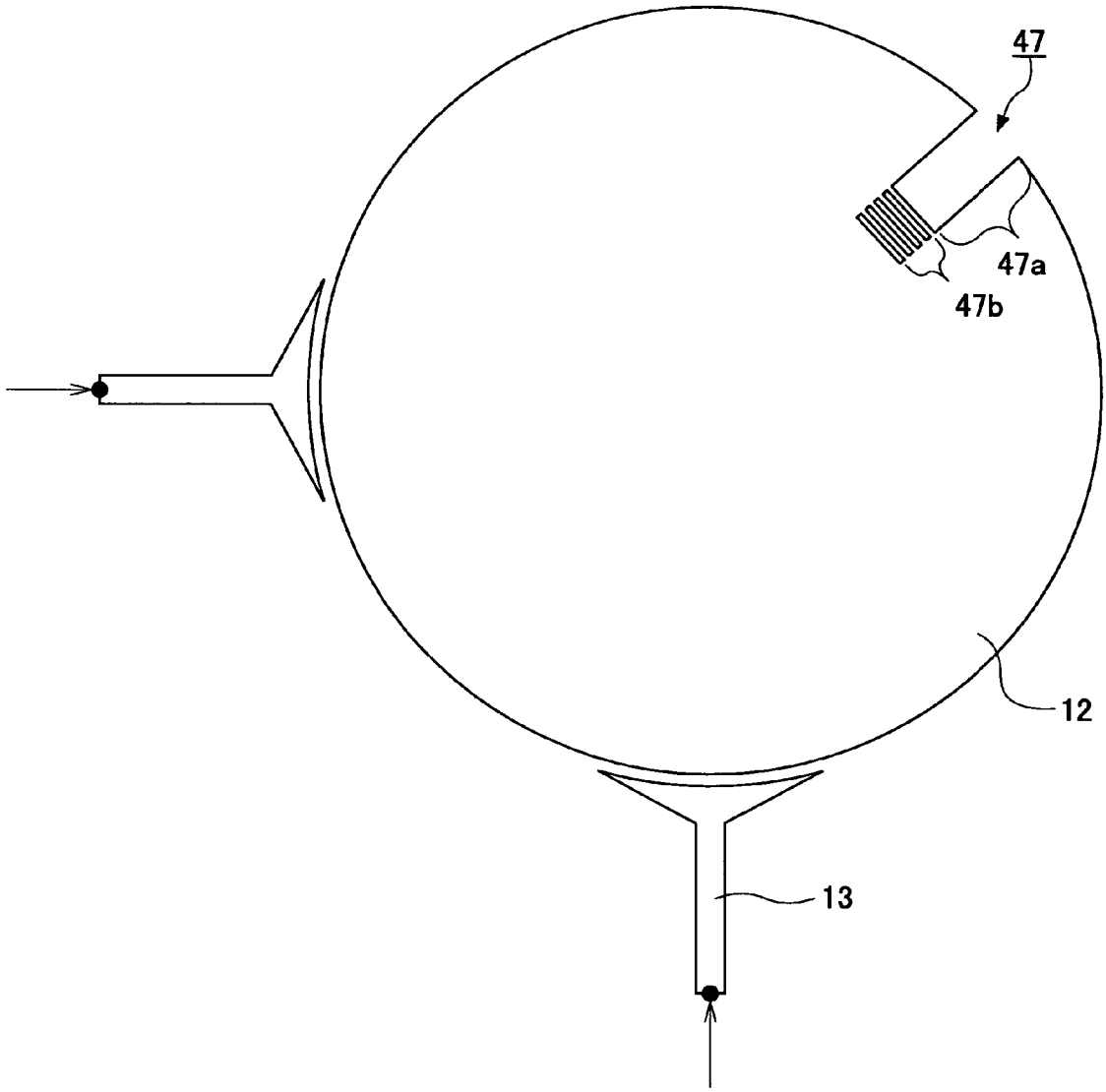
FIG. 22 is a schematic diagram illustrating another example of the ladder pattern (pattern 2) formed in the disk resonator.

FIG. 22 illustrates a second example of ladder pattern 47 (Pattern 2) formed in the disk resonator pattern 12. In this example, the diameter of the disk pattern 12 is 12.8 mm, the amount of cut from the circumference (that is, the size of the notch 47*a*) is 1.789 mm, and the length of the line-and-space section 47*b* extending from the notch 47*a* in the radial direction is 0.8 mm. Four lines are formed at a line width of 100 μm. The space width between adjacent lines is 100 μm, which width is set below a quarter of the effective wavelength (λ/4). The lateral width in the tangential direction of ladder pattern 47 is about 1 mm.

Figure 23:
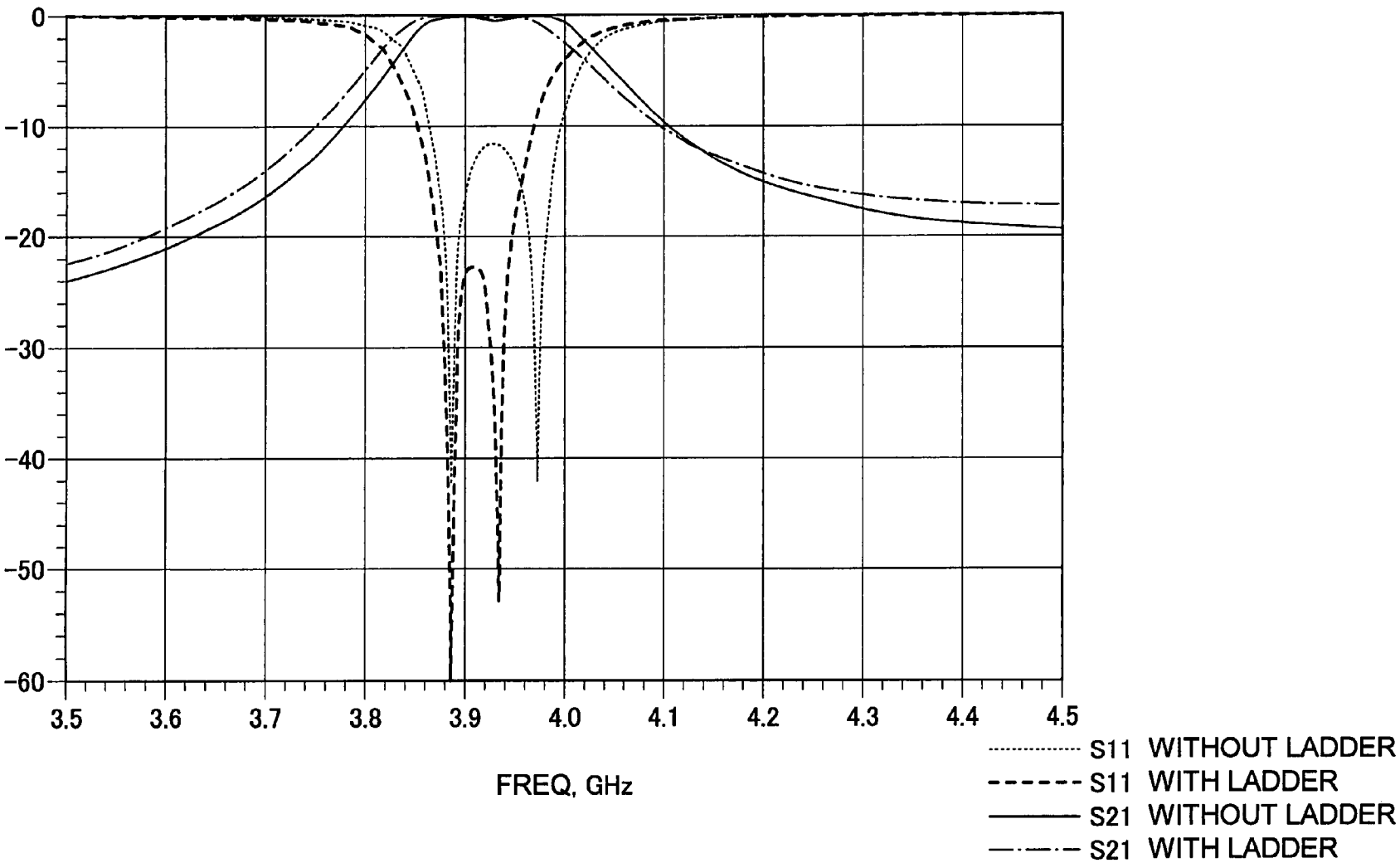
FIG. 23 is a graph showing the filter characteristics of the disk resonator with ladder pattern 2.
Figure 24:
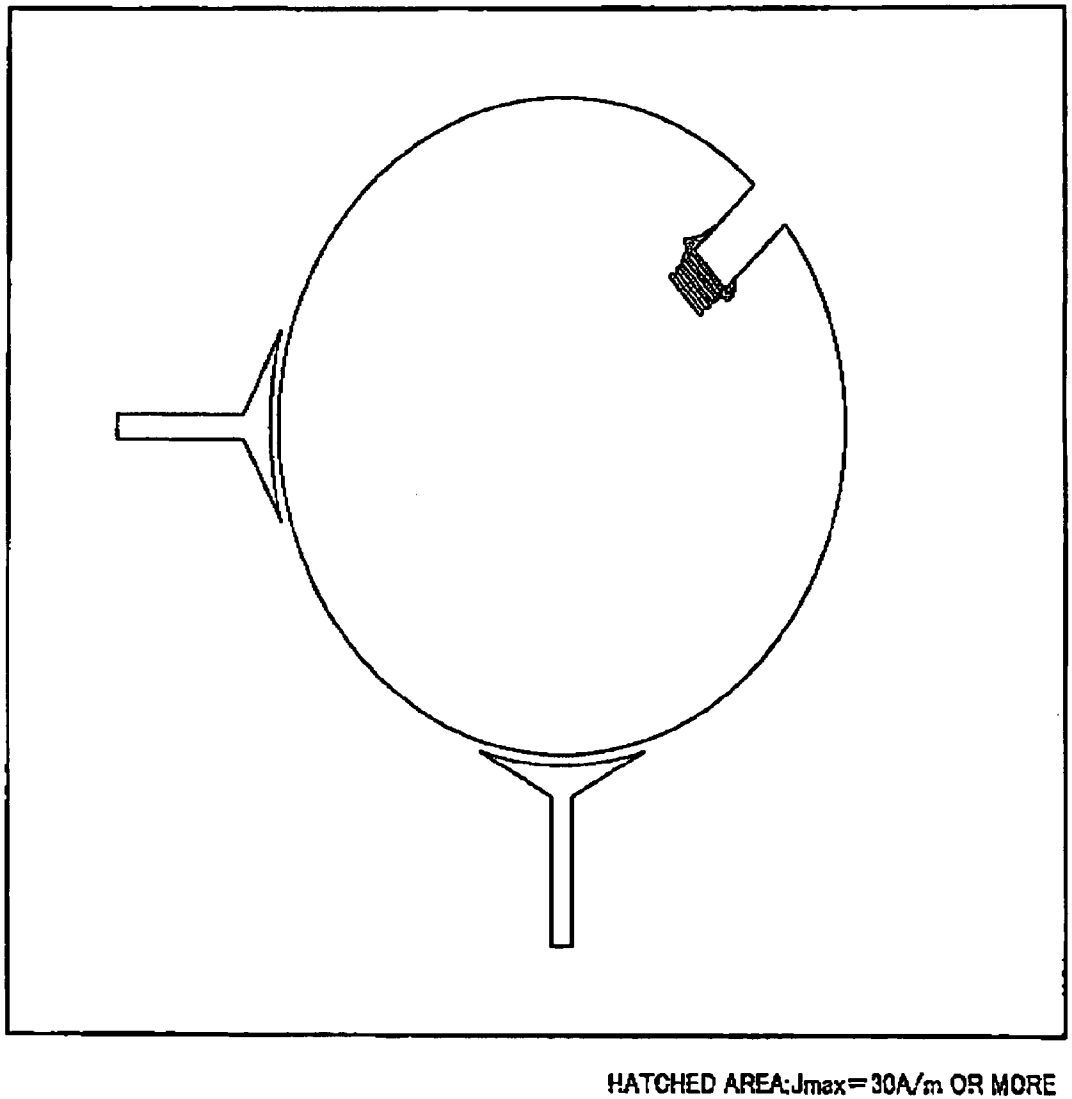
FIG. 24 is a schematic diagram illustrating distribution of electric current density in the disk resonator with ladder pattern 2.

FIG. 23 is a graph showing the filter characteristics of the resonant filter having the ladder pattern 47 (Pattern 2) shown in FIG. 22, and FIG. 24 is a schematic diagram illustrating distribution of electric current density in the resonant filter with the ladder pattern 47 shown in FIG. 22. The shaded area in FIG. 23 is a region of high current density, in which the maximum current density Jmax is at or more than 30 A/m. In FIG. 23, S11 is the input reflection characteristic of the resonant filter pattern with and without the ladder pattern 47 shown in FIG. 22. S21 is the transmission characteristic of the resonant filter pattern with and without the ladder pattern 47 shown in FIG. 22.

The ladder pattern 47 (Pattern 2) shown in FIG. 22 can produce resonant frequencies of two modes in a satisfactory manner, and has a transmission characteristic of an acceptable level so as to function as a bandpass filter. This is because the ladder pattern 47 has a notch 47*a* of an appropriate size.

It should be noted that in FIG. 23 the center frequency of the device (resonant filter) with the ladder pattern 47 slightly shifts from the ordinary square-notched resonator pattern whose notch size is equivalent to that of the ladder pattern 47. This means that the pass band width and the resonant frequencies can be adjusted finely by providing a ladder pattern.

As illustrated in FIG. 24, electric current tends to converge to the first line of the line-and-space section 47*b* (which is the closest to the circumference); however, the current concentration reducing effect can be achieved as a whole of the resonant filter pattern. The convergence of electric current on the first line can be reduced to some extent by making the corner of the notch 47*a* round with a radius of curvature less that a quarter of the effective wavelength (λ/4), or broadening the line width at both ends.

Figure 25A:
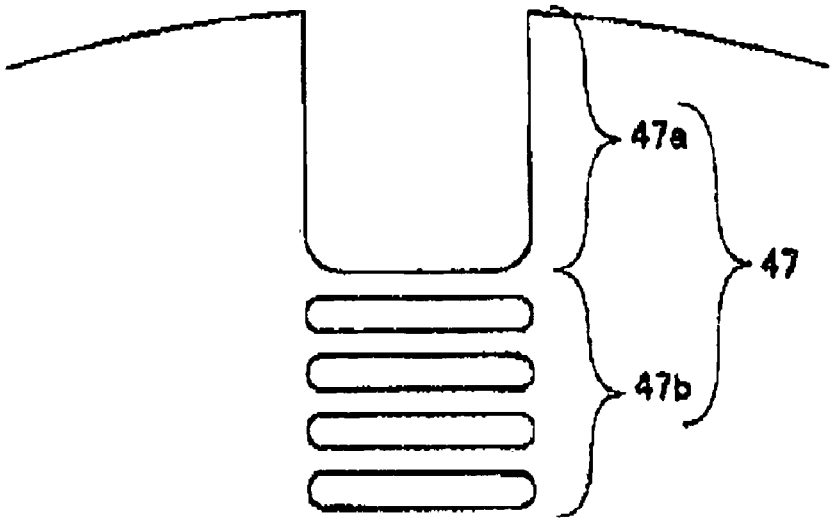
FIG. 25A and FIG. 25B are modifications of the ladder pattern formed in the disk resonator.
Figure 25B:
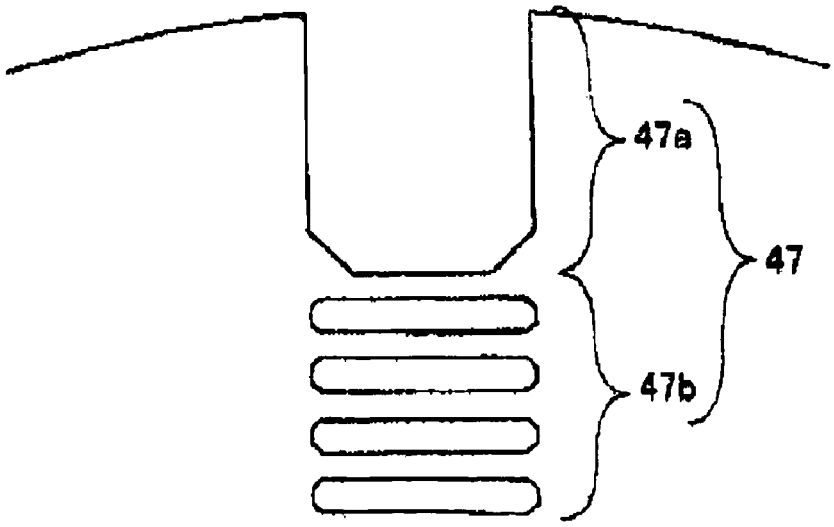

FIG. 25A and FIG. 25B illustrate modifications of the ladder pattern 47 with variations of the line-and-space section 47*b*. In FIG. 25A, the bottom corners of the notch 47*a* and the corners of each space in the line-and-space section 47*b* are arced at a radius of curvature below λ/4. In FIG. 25B, these corners 47*a* are chamfered with straight lines. In either example, the end portions of each line are widened so as to prevent electric current from converging to the lines of the ladder pattern 47.

Figure 26:
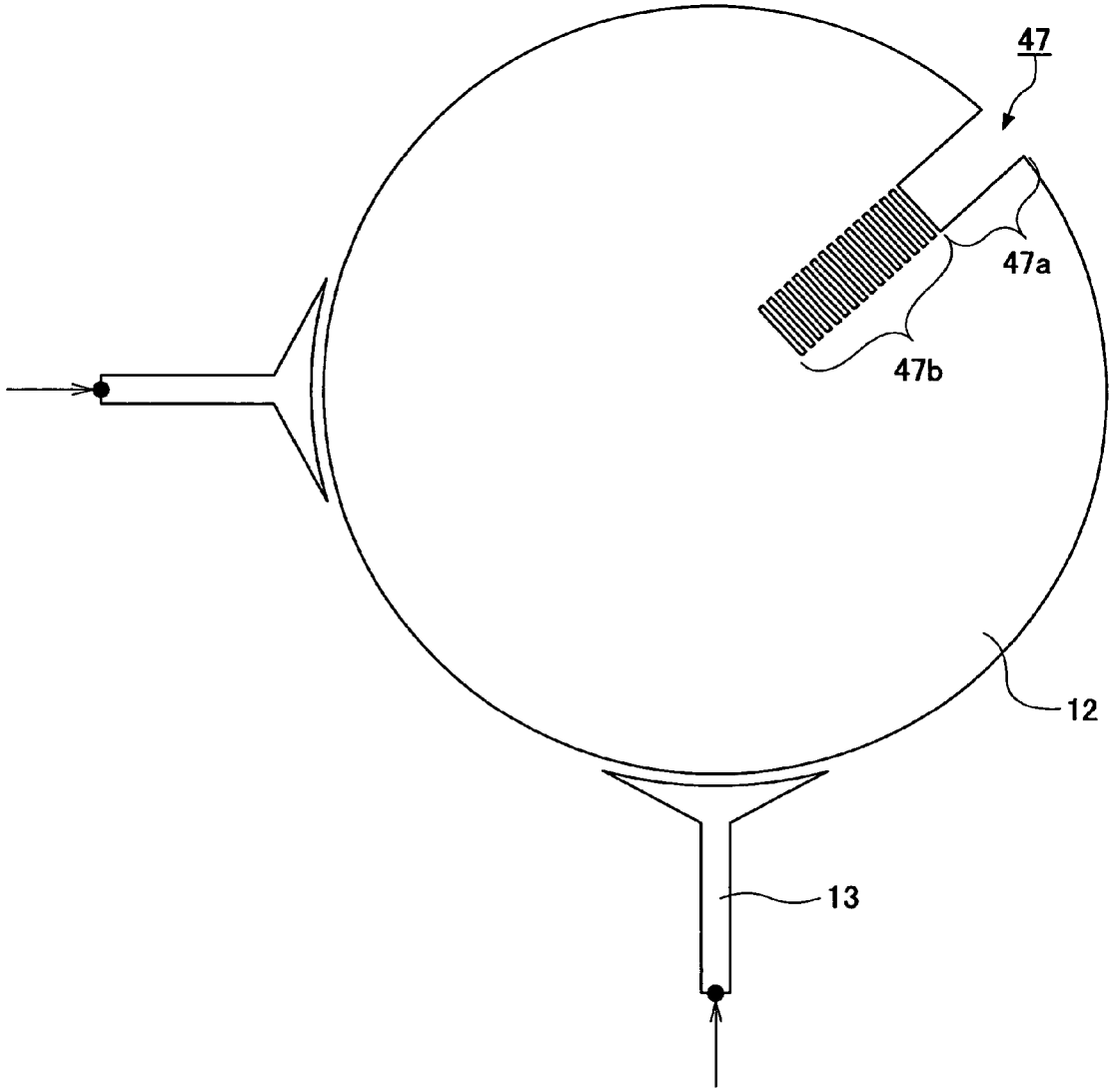
FIG. 26 is a schematic diagram illustrating still another example of the ladder pattern (pattern 3) formed in the disk resonator.

FIG. 26 illustrates a third example of ladder pattern 47 (Pattern 3) formed in the disk resonator pattern 12. In this example, the diameter of the disk pattern 12 is 12.8 mm, the amount of cut from the circumference (that is, the size of the notch 47*a*) is 1.0 mm, and the length of the line-and-space section 47*b* extending from the notch 47*a* in the radial direction is 3.2 mm. Sixteen (16) lines are formed at a line width of 100 μm. The space width between adjacent lines is 100 μm, which width is set below a quarter of the effective wavelength (λ/4). The lateral width in the tangential direction of ladder pattern 47 is about 1 mm.

Figure 27:
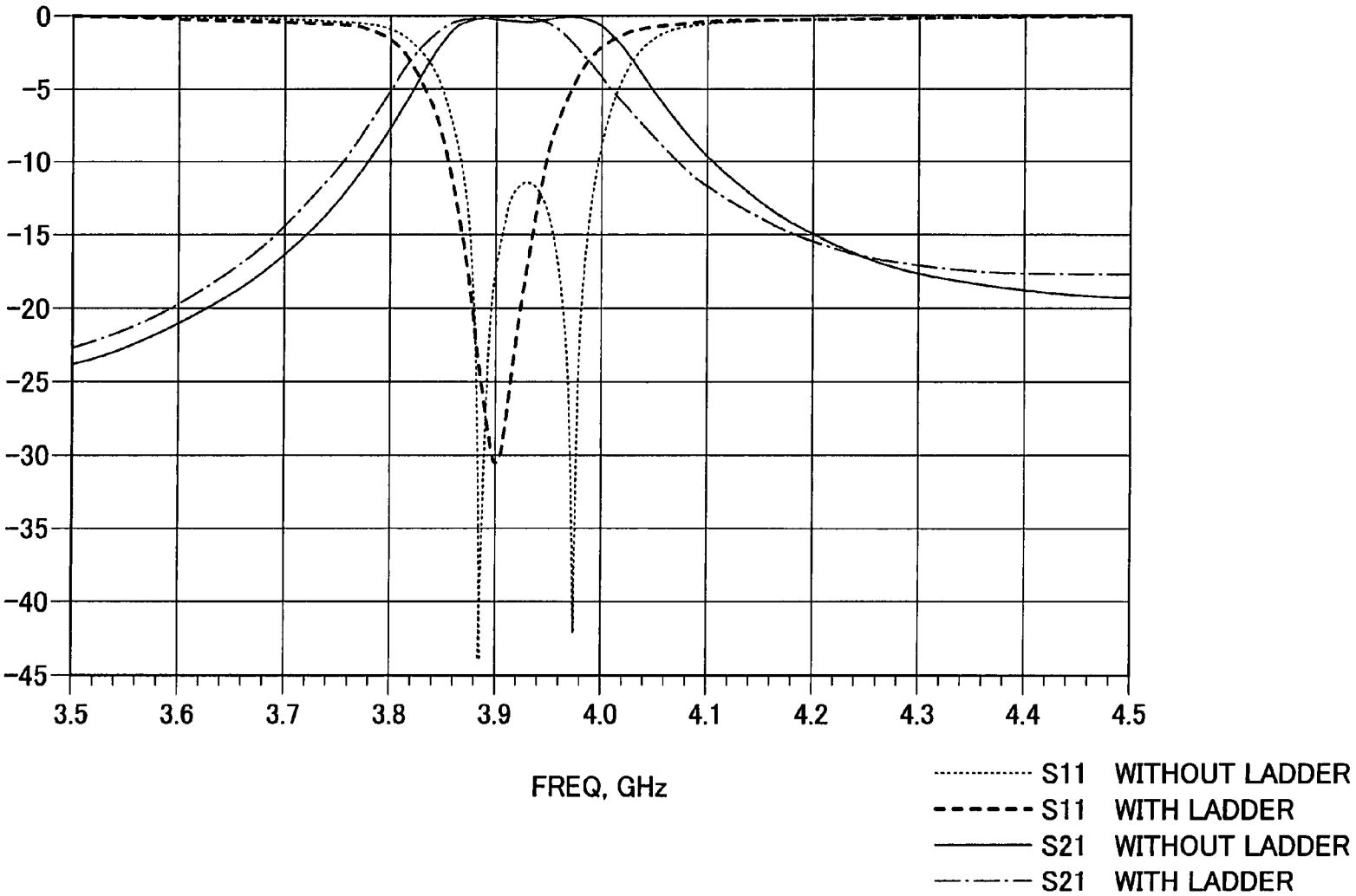
FIG. 27 is a graph showing the filter characteristics of the disk resonator with ladder pattern 3.

FIG. 27 is a graph showing the filter characteristics of the resonant filter having the ladder pattern 47 (Pattern 3) shown in FIG. 26, and FIG. 28 is a schematic diagram illustrating distribution of electric current density in the resonant filter with the ladder pattern 47 shown in FIG. 26. In FIG. 27, S11 is the input reflection characteristic of the resonant filter pattern with and without the ladder pattern 48 shown in FIG. 26. S21 is the transmission characteristic of the resonant filter pattern with and without the ladder pattern 47 shown in FIG. 26.

As illustrated in FIG. 27, when the ladder pattern 12 extends close to the center of the disk pattern 12, as shown in FIG. 26, resonant frequencies of two modes cannot be produced. Although the filtering characteristics are satisfactory, the device functions only as a single-mode resonator, not a dual-mode resonator.

As illustrated in FIG. 28, electric current is more likely to converge on the lines located near the circumference, as well as on the end portions of each line of the line-and-space section 47*b*. This means that if the line-and-space section 47*b* of the ladder pattern 47 is too long, the device does not function as a dual-mode resonator, and cannot reduce localized concentration of electric current.

From the observation of the first through third examples of the ladder pattern 47 (Patterns 1-3) described above in conjunction with FIG. 19 through FIG. 28, the following points are derived.

(1) The basic characteristics for a dual-mode filter are determined by the cut amount or the size of the notch 47*a* of the ladder pattern 47;

(2) Fine adjustment of the center frequency anchor the band width can be made by forming the line-and-space section 47*b*; and (3) The effect for reducing electric current concentration is determined by the starting position and the end position of the line-and-space section 47*b*.

In other words, by appropriately selecting the cut amount of the notch 47*a* and the size of the line-and-space section 47*b* of the ladder pattern 47*a*, a dual-mode superconducting resonant filter with satisfactory filtering characteristic and tolerable power characteristic can be realized.

To be more precise, the notch 47*a* of the ladder pattern 47 needs to be deep enough to produce different resonant frequencies of two modes from comparison between Pattern 1 and Pattern 2. The length of the ladder pattern 47 is preferably less than half (½), and more preferably, less than one third (⅓) of the distance between the circumference and the center (that is, the radius) of the disk resonator pattern 12 from comparison between Pattern 2 and Pattern 3. These points apply not only to a disk pattern, but also to other shapes of resonator pattern, such as an oval or polygonal pattern.

The superconducting device of the third embodiment with an improved tolerable power characteristic is suitable for a dual-mode transmission resonant filter or an antenna, and can provide a high-performance transmission/receiving frontend in the field of mobile communications and broadcasting.

Although the preferred embodiments are described using specific examples, the invention is not limited to these examples.

For example, in place of the YBCO-based thin film, any suitable superconducting oxide, such as a RBCO (R—Ba—Cu—O) based thin film in which Nd, Gd, Sm, or Ho is used in place of Y (yttrium) as the R element, may be used as the superconductive material. Alternatively, a BSCCO (Bi—Sr—Ca—Cu—O) based material, a PBSCCO (Pb—Bi—Sr—Ca—Cu—O) based material, or CBCCO (Cu—$Ba_p$—$Ca_q$—$Cu_r$—$O_x$ where 1.5<p<2.5, 2.5<q<3.5, and 3.5<r<4.5) based material may be used as the superconductive material.

The dielectric substrate is not limited to the single crystal MgO substrate, and it may be replaced by another material, such as a $LaAlO_3$ substrate on a sapphire substrate.

This patent application is based on and claims the benefit of the earlier filing dates of Japanese Patent Application Nos. 2004-284670 filed Sep. 29, 2004, 2004-303301 filed Oct. 18, 2004, and 2005-233037 filed Aug. 11, 2005, the entire contents of which are incorporated herein by reference.

What is claimed is:

1. A superconducting device comprising:

a dielectric substrate; and a plane-figure type resonator pattern comprised of a superconductive material and disposed on a first face of the dielectric substrate, wherein the resonator pattern has a notch for generating two orthogonal resonating modes in a 4 GHz band and disposed inwardly from a peripheral edge of be resonator pattern, at least a portion of said notch being round.

2. The superconducting device of claim 1, wherein a radius of curvature of the round portion of the notch is at or below a quarter of an effective wavelength (λ/4) of a high frequency signal used in the dielectric substrate.

3. The superconducting device of claim 1, wherein the dielectric substrate has a dielectric constant ranging from 8 to 10 at a frequency of 3 GHz to 5 GHz.

4. The superconducting device of claim 1, further comprising:

a ground film disposed on a second face of the dielectric substrate, the first and second faces being opposite to each other; and a signal input/output line extending toward the resonator pattern, wherein the resonator pattern produces resonant frequencies of two modes orthogonal to each other in the 4 GHz band.

5. The superconducting device of claim 1, wherein the superconductive material is a superconducting oxide.

6. The superconducting device of claim 1, wherein the resonator pattern is a disk pattern.

7. The superconducting device of claim 1, wherein the notch is U-shaped or semicircular.

8. A superconducting device comprising:

a dielectric substrate; and a plane-figure type resonator pattern comprised of a superconductive material and disposed on a first face of the dielectric substrate, wherein the resonator pattern has a notch for generating two orthogonal resonating modes and disposed inwardly from a peripheral edge of the resonator pattern, at least a portion of said notch being round.

* * * * *